US008091524B2

(12) United States Patent
Ozawa et al.

(10) Patent No.: US 8,091,524 B2
(45) Date of Patent: Jan. 10, 2012

(54) VALVE TIMING CONTROL DEVICE

(75) Inventors: Yasuo Ozawa, Kariya (JP); Yuki Nishida, Kariya (JP); Masaki Kobayashi, Okazaki (JP); Yoshihiro Kawai, Obu (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 253 days.

(21) Appl. No.: 12/508,134

(22) Filed: Jul. 23, 2009

(65) Prior Publication Data

US 2010/0050966 A1 Mar. 4, 2010

(30) Foreign Application Priority Data

Sep. 4, 2008 (JP) ..... 2008-227264
Apr. 6, 2009 (JP) ..... 2009-092302

(51) Int. Cl.
*F01L 1/34* (2006.01)

(52) U.S. Cl. ..... 123/90.17; 464/160

(58) Field of Classification Search ..... 123/90.17; 464/160, 161

See application file for complete search history.

(56) References Cited

U.S. PATENT DOCUMENTS

| | | | | |
|---|---|---|---|---|
| 6,053,139 | A | 4/2000 | Eguchi et al. | |
| 6,334,414 | B1 * | 1/2002 | Okada et al. | 123/90.15 |
| 6,378,475 | B2 * | 4/2002 | Takenaka et al. | 123/90.17 |
| 6,378,476 | B2 * | 4/2002 | Okada et al. | 123/90.17 |
| 6,439,184 | B1 * | 8/2002 | Takenaka et al. | 123/90.17 |
| 6,634,329 | B2 * | 10/2003 | Kusano et al. | 123/90.17 |
| 6,739,298 | B2 * | 5/2004 | Kusano et al. | 123/90.17 |
| 6,779,499 | B2 * | 8/2004 | Takenaka et al. | 123/90.17 |
| 7,089,898 | B2 * | 8/2006 | Tsukada | 123/90.17 |
| 7,363,898 | B2 | 4/2008 | Suzuki et al. | |
| 2001/0054406 | A1 * | 12/2001 | Okada et al. | 123/90.17 |
| 2005/0205032 | A1 | 9/2005 | Lehmann et al. | |
| 2005/0284432 | A1 | 12/2005 | Tsukada | |
| 2005/0284433 | A1 | 12/2005 | Yaoko et al. | |
| 2007/0039580 | A1 | 2/2007 | Heintzen et al. | |
| 2007/0144475 | A1 | 6/2007 | Suzuki et al. | |

FOREIGN PATENT DOCUMENTS

| | | | |
|---|---|---|---|
| DE | 10 2005 034 320 | A1 | 1/2007 |
| JP | 11-311107 | A | 11/1999 |
| JP | 2002-357105 | A | 12/2002 |
| JP | 2007-198365 | A | 8/2007 |

OTHER PUBLICATIONS

Search Report issued Dec. 21, 2009 by the European Patent Office in European Patent Application No. 09011226.9.

* cited by examiner

*Primary Examiner* — Thomas Denion
*Assistant Examiner* — Daniel Bernstein
(74) *Attorney, Agent, or Firm* — Buchanan Ingersoll & Rooney PC

(57) ABSTRACT

A valve timing control device includes a driving side rotational member, a driven side rotational member, a fluid pressure chamber, a parting portion dividing the fluid pressure chamber into an advanced angle chamber and a retarded angle chamber, a restriction member, a restriction recessed portion for restricting a displacement of a relative rotational phase within a range between a most advanced angle phase or a most retarded angle phase and a predetermined phase when the restriction member is inserted into the restriction recessed portion, and a restriction cancellation passage, wherein a communication between the accommodation portion and one of the advanced angle chamber and the retarded angle chamber via the cancellation passage is interrupted at least when the restriction member contacts one of end portions of the restriction recessed portion, and the restriction member is restricted so as not to move over the other one of the end portions.

20 Claims, 15 Drawing Sheets

VALVE TIMING CONTROL DEVICE

CROSS REFERENCE TO RELATED APPLICATIONS

This application is based on and claims priority under 35 U.S.C. §119 to Japanese Patent Application 2008-227264, filed on Sep. 4, 2008, and Japanese Patent Application 2009-092302, filed Apr. 6, 2009, the entire contents of which are incorporated herein by reference.

TECHNICAL FIELD

The present invention generally relates to a valve timing control device.

BACKGROUND

Disclosed in JP2007-198365A is a valve timing control device, which includes a restriction recessed portion formed at a driven side rotational member and a restriction member provided at a driving side rotational member so as to be insertable/retractable into/from the restriction recessed portion, so that a relative rotational phase between the driving side rotational member and the driven side rotational member to be controlled within a predetermined range between a most retarded angle phase and a predetermined phase, which is a phase between the most retarded angle phase and a most advanced angle phase, when the restriction member is inserted into the restriction recessed portion. The valve timing control device disclosed in JP2007-198365A further includes a restriction passage for supplying an operation fluid, which is supplied to a retarded angle chamber, to the restriction recessed portion in order to release a restriction of displacement of the relative rotational phase by retracting the restriction member from the restriction recessed portion, and a retention mechanism for retaining the restriction member at a state where the restriction member is retracted from the restriction recessed portion by supplying some of the operation fluid, which is supplied to an advanced angle chamber, to an accommodating chamber for accommodating the restriction member.

Furthermore, the valve timing control device disclosed in JP2007-198365A includes a valve mechanism, which is configured so as to be displaceable in response to the fluid supplied to the advanced angle chamber and so as to open/close the restriction passage. Once the valve mechanism opens the restriction passage, an open state of the restriction passage is maintained in any cases where a retarded angle control or an advanced angle control is executed. Generally, the operation fluid may be supplied to the restriction recessed portion and/or the accommodating chamber by a cranking of a crankshaft of an internal combustion engine. For example, in a case where a flow switching valve of the valve timing control device is controlled to execute the retarded angle control when the internal combustion engine is being stopped, the operation fluid may be improperly supplied to the restriction recessed portion by the cranking of the crankshaft, which may result in retracting the restriction member. In this case, the relative rotation between the driving side rotational member and the driven side rotational member may not be controlled at the predetermined phase. In order to avoid the operation fluid to be supplied to the restriction recessed portion and/or the accommodating chamber by a cranking, the valve mechanism is provided to the valve timing device disclosed in JP2007-198365A A valve timing control device disclosed in JP2002-357105A includes an advanced angle restricting mechanism for restricting a displacement of a relative rotational angle from a predetermined phase, which is set to be a phase between a most advanced angle phase and a most retarded angle phase, towards an advanced angle phase, a retarded angle restricting mechanism for restricting the displacement of the relative rotational phase from the predetermined phase towards a retarded angle phase, and a flow switching valve for switching a flow of an operation fluid, by which operations of the advanced angle restricting mechanism and the retarded angle restricting mechanism are controlled. According to the valve timing device disclosed in JP2002-357105A, each of the advanced angle restricting mechanism and the retarded angle restricting mechanism includes a restriction member and a restriction recessed portion, into which the restriction member is insertable, so that the displacement of the relative rotational phase is restricted by the restriction member being inserted into the restriction recessed portion. A depth of the restriction recessed portion of the restriction member corresponding to the relative rotational phase is formed to be deeper than other portions of the restriction recessed portion, so that the relative rotational phase is locked at the predetermined phase when the restriction member is engaged with the portion of the restriction recessed portion whose depth is formed to be deeper. Furthermore, the valve timing control device includes an oil pressure controlling valve, which controls the restriction of the advanced angle restricting mechanism and the retarded angle restricting mechanism.

A valve timing control device disclosed in JPH11-311107A includes a restriction member and a restriction recessed portion. According to the valve timing control device disclosed in JPH11-311107A, the restriction recessed portion includes a separate operation fluid passage for supplying an operation fluid to the restriction recessed portion.

However, according to the valve timing control device disclosed in JP2007-198365A, the valve timing control device disclosed in JP2002-357105A and the valve timing control device disclosed in JPH11-311107A, the valve mechanism, the separate operation fluid passage, the separate oil pressure controlling valve and the like need to be provided in order to surely control insertion/retraction of the restriction member into/from the restriction recessed portion so that the restriction member is not retracted from the restriction recessed portion in a case where the relative rotational phase needs to be controlled at the predetermined phase, which is set to be the phase between the most advanced angle phase and the most retarded angle phase. Accordingly, a number of components used for the valve timing control device may increase. Further, mountability of the valve timing control device may deteriorate and manufacturing costs for the valve timing control device may increase.

A need thus exists to provide a chromatography device which is not susceptible to the drawback mentioned above.

SUMMARY OF THE INVENTION

According to an aspect of the present invention, a valve timing control device includes a driving side rotational member synchronously rotatable with a crankshaft of an internal combustion engine, a driven side rotational member arranged coaxially with the driving side rotational member and synchronously rotatable with a camshaft that controls opening and closing operations of a valve of the internal combustion engine, a fluid pressure chamber defined by the driving side rotational member and the driven side rotational member, a parting portion provided at at least one of the driving side rotational member and the driven side rotational member in order to divide the fluid pressure chamber into an advanced angle chamber and a retarded angle chamber, a restriction member accommodated within an accommodation portion, which is formed at one of the driving side rotational member and the driven side rotational member and being insertable into and retractable from the other one of the driving side rotational member and the driven side rotational member, a restriction recessed portion formed in an elongated groove shape at the other one of the driving side rotational member and the driven side rotational member so that the restriction member is insertable thereinto and restricting a displacement of a relative rotational phase of the driven side rotational member relative to the driving side rotational member in a range between one of a most advanced angle phase and a most retarded angle phase on the one hand and a predetermined phase between the most advanced angle phase and the most retarded angle phase on the other when the restriction member is inserted into the restriction recessed portion, and a restriction cancellation passage for connecting one of the advanced angle chamber and the retarded angle chamber and the accommodation portion in response to a rotatable movement of the driven side rotational member relative to the driving side rotational member so that the accommodation portion becomes in communication with the one of the advanced angle chamber and the retarded angle chamber and for canceling a restriction generated between the restriction member and the restriction recessed portion, wherein a communication between the accommodation portion and the one of the advanced angle chamber and the retarded angle chamber via the cancellation passage is interrupted at least when the restriction member contacts one of first and second end portions of the restriction recessed portion in a rotational direction of the other one of the driving side rotational member and the driven side rotational member, and the restriction member is restricted so as not to move over the other one of the first and second end portions of the restriction recessed portion, positioned so as to correspond to the predetermined phase, to be disengaged from the restriction recessed portion.

According to another aspect of the present invention, a valve timing control device includes an outer rotor synchronously rotatable with a crankshaft of an internal combustion engine, an inner rotor arranged coaxially with the outer rotor and synchronously rotatable with a camshaft that controls opening and closing operations of a valve of the internal combustion engine, a fluid pressure chamber defined by the outer rotor and the inner rotor, a parting portion provided at at least one of the outer rotor and the inner rotor so as to divide the fluid pressure chamber into an advanced angle chamber and a retarded angle chamber, a restriction member accommodated within an accommodation portion, which is formed at one of the outer rotor and the inner rotor and being insertable into and retractable from the other one of the outer rotor and the inner rotor, a restriction recessed portion formed in an elongated groove shape at the other one of the outer rotor and the inner rotor so that the restriction member is insertable thereinto and restricting a displacement of a relative rotational phase of the inner rotor relative to the outer rotor in a range between one of a most advanced angle phase and a most retarded angle phase on the one hand and a predetermined phase between the most advanced angle phase and the most retarded angle phase on the other when the restriction member is inserted into the restriction recessed portion, and a restriction cancellation passage for connecting one of the advanced angle chamber and the retarded angle chamber with the accommodation portion in response to a rotatable movement of the inner rotor relative to the outer rotor so that the accommodation portion becomes in communication with the one of the advanced angle chamber and the retarded angle chamber and for canceling a restriction generated between the restriction member and the restriction recessed portion, wherein a communication between the accommodation portion and the one of the advanced angle chamber and the retarded angle chamber via the cancellation passage is interrupted at least when the restriction member contacts one of first and second end portions of the restriction recessed portion in a rotational direction of the other one of the outer rotor and the inner rotor, and a range of the relative rotational phase of the inner rotor relative to the outer rotor to be displaced is restricted to a range between the one of the most advanced angle phase and the most retarded angle phase on the one hand and the predetermined phase between the most advanced angle phase and the most retarded angle phase on the other.

BRIEF DESCRIPTION OF THE DRAWINGS

The foregoing and additional features and characteristics of the present invention will become more apparent from the following detailed description considered with the reference to the accompanying drawings, wherein:

FIG. 14B is an expanded cross sectional side view illustrating the state of the restriction member and the like.

DETAILED DESCRIPTION

First Embodiment

A first embodiment of a valve timing control device, which is adapted to an engine for a vehicle so as to be adapted to an exhaust valve, will be described below with reference to FIGS. 1 to 7 of the attached drawings.

<Entire Configuration>

Figure 1:
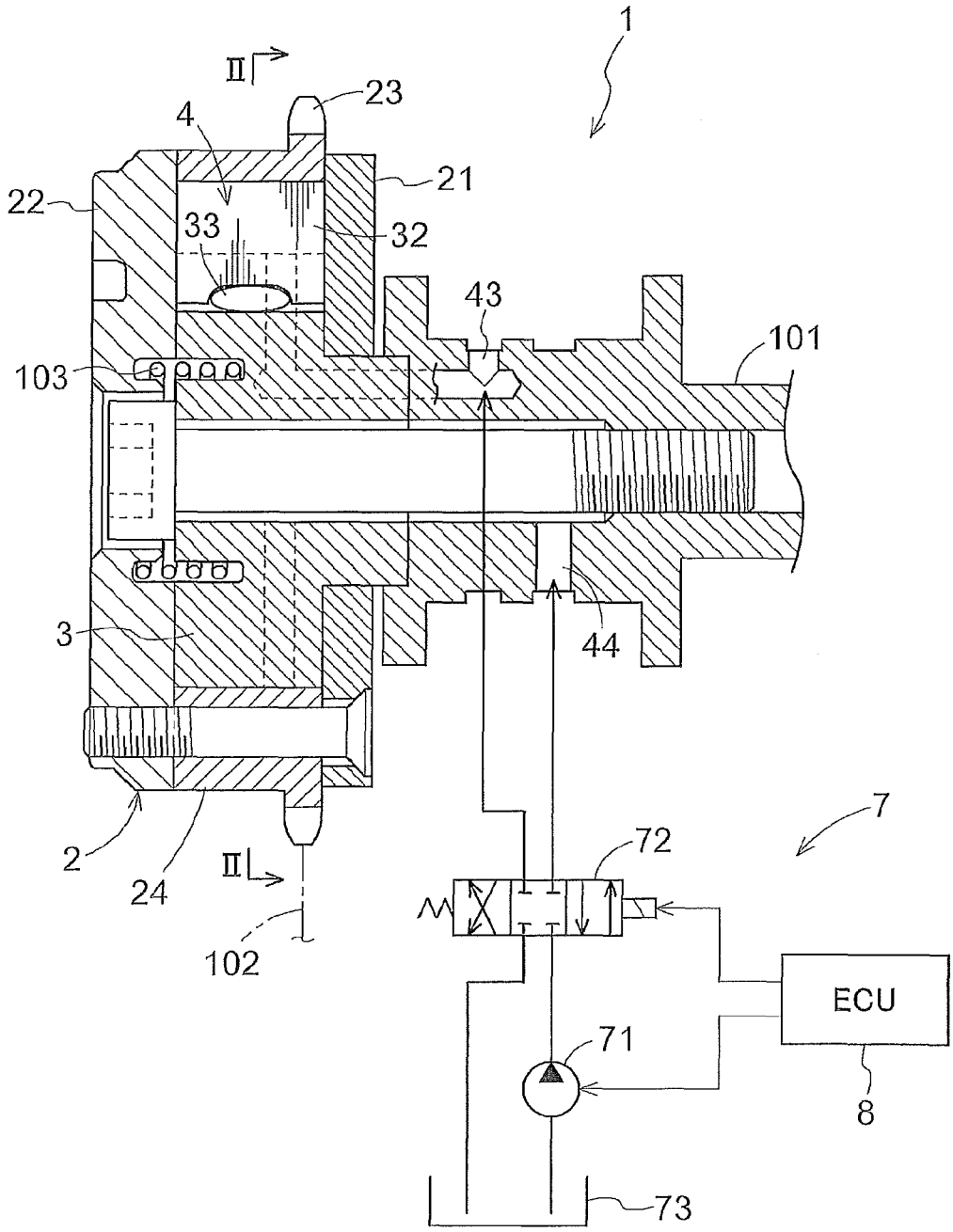
FIG. 1 is a cross sectional side view schematically illustrating a configuration example of an entire valve timing control device according to a first embodiment.

As illustrated in FIG. 1, a valve timing control device 1 includes an outer rotor 2, which serves as a driving side rotational member, and an inner rotor 3, which serves as a driven side rotational member. The outer rotor 2 is synchronously rotatable relative to a crankshaft of the engine (an internal combustion engine). The inner rotor 3 is arranged coaxially with the outer rotor 2 and synchronously rotatable with a camshaft 101. The camshaft 101 is a rotational shaft of a cam, which controls opening and closing operations of the exhaust valves of the engine.

Figure 2:
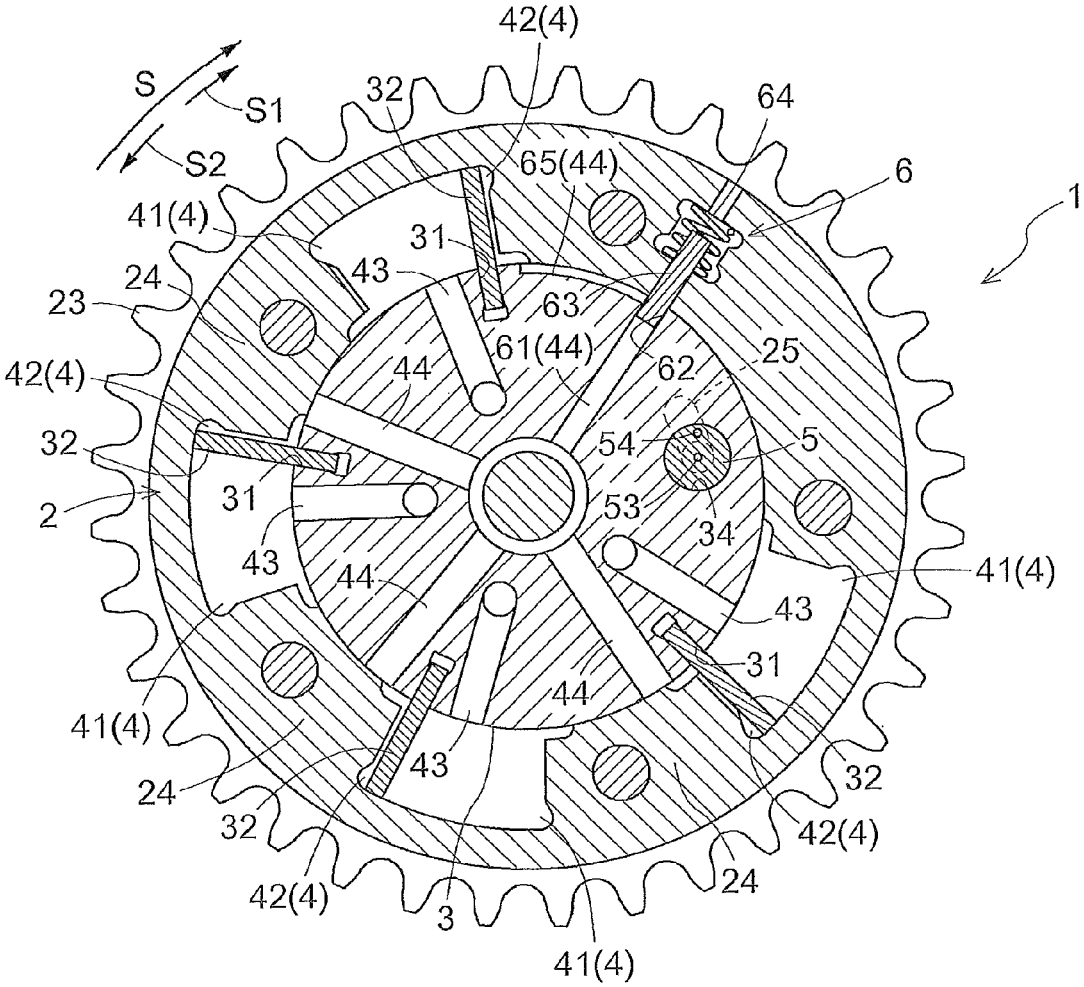
FIG. 2 is a cross sectional view taken along line II-II of FIG. 1.

As illustrated in FIG. 2, the valve timing control device 1 further includes a restriction member 5, a restriction recessed portion 25 and a restriction cancellation passage. The restriction member 5 is provided within an accommodation portion 34, which is formed at the inner rotor 3. Further, the restriction member 5 is configured so as to be insertable/retractable into/from the outer rotor 2. The restriction recessed portion 25 is formed in an elongated bore shape at the outer rotor 2 so that the restriction member 5 is insertable into the restriction recessed portion 25. The restriction cancellation passage is configured so as to cancel a restriction generated by the restriction member 5 and the restriction recessed portion 25.

<Inner Rotor and Outer Rotor>

The inner rotor 3 is integrally attached to an end portion of the camshaft 101. The camshaft 101 is rotatably assembled onto a cylinder head of the engine.

The outer rotor 2 is integrally provided with a timing sprocket 23. The outer rotor 2 is attached on a radially outer side of the inner rotor 3. A rear plate 21 and a front plate 22 are attached to the outer rotor 2 and the inner rotor 3 in such a way to sandwich the outer rotor 2 and the inner rotor 3 from axially opposite sides. Precisely, the rear plate 21 is positioned on the axial one side close to the camshaft 101 while the front plate 22 is positioned on the axial other side away from the camshaft 101. The front plate 22, the outer rotor 2 and the rear plate 21 are fixed with one another by means of a bolt and the like. Accordingly, the outer rotor 2 is configured so as to be rotatable relative to the inner rotor 3 within a predetermined range.

When the crankshaft of the engine is driven to rotate, its rotational driving force is transmitted to the timing sprocket 23 via a power transmission member 102. Accordingly, the outer rotor 2 is driven to rotate in a relative rotational direction S indicated in FIG. 2. In response to the rotation of the outer rotor 2, the inner rotor 3 rotates in the relative rotational direction S, thereby rotating the camshaft 101. As a result, the cam provided at the camshaft 101 presses down the exhaust valves, thereby opening the exhaust valves.

As illustrated in FIG. 2, plural protruding portions 24, each of which inwardly extends in a radial direction of the outer rotor 2, are arranged at the outer rotor 2 along the relative rotational direction S, while keeping a distance from each other in the relative rotational direction S. A fluid pressure chamber 4 is formed by the inner rotor 3 and each of the protruding portions 24. According to the first embodiment, as illustrated in FIG. 2, four fluid pressure chambers 4 are formed. However, the present invention is not limited to the above-described configuration, but any desired number of fluid pressure chambers 4 may be formed.

As illustrated in FIG. 2, vane grooves 31 are formed at an outer circumferential portion of the inner rotor 3, facing the fluid pressure chambers 4, respectively, so as to open towards the fluid pressure chambers 4, respectively. Vanes 32 (i.e. parting portions) are inserted into the respective vane grooves 31 in such a way to be slidable in a radial direction of the inner rotor 3. Each vane 32 divides each fluid pressure chamber 4 into an advanced angle chamber 41 and a retarded angle chamber 42 in the relative rotational direction S. Each of the vanes 32 is biased towards the outer rotor 2 in the radial direction thereof by means of a spring 33 (see FIG. 1), which is provided at a radially inner side of the vanes 32.

Advanced angle passages 43 are formed at the inner rotor 3 so as to be in communication with the advanced angle chambers 41, respectively. Retarded angle passages 44 are formed at the inner rotor 3 so as to be in communication with the retarded angle chambers 42, respectively. As illustrated in FIG. 1, the advanced angle passages 43 and the retarded angle passages 43 are connected to an operation fluid supply and discharge mechanism 7, which will be explained later, as illustrated in FIG. 1.

A fluid (i.e. an operation fluid, which will be also referred to as an operation oil) is supplied/discharged to/from one of the advanced angle chambers 41 on the one hand and the retarded angle chambers 42 on the other hand by means of the operation fluid supply and discharge mechanism 7, so that a fluid pressure of the operation fluid acts on the vanes 32. Accordingly, a relative rotational phase of the outer rotor 2 relative to the inner rotor 3 is displaced (i.e. the relative rotational phase between the outer rotor 2 and the inner rotor 3 is changed in response to a relative rotation therebetween) in an advanced angle direction S1 or in a retarded angle direction S2, as illustrated in FIG. 2. Alternatively, the relative rotational phase between the outer rotor 2 and the inner rotor 3 is retained at an appropriate phase. In this embodiment, an operation oil is used as the operation fluid. The advanced angle direction S1 is a direction in which the vanes 32 are rotatably displaced relative to the outer rotor 21 and in which a volume of each of the advanced angle chambers 41 increases. The retarded angle direction S2 is a direction in which a volume of each of the retarded angle chambers 42 increases.

The predetermined range, in which the inner rotor 3 and the outer rotor 2 are rotatable relative to each other, corresponds to a range in which vanes 32 are displaceable within the respective fluid chambers 4. A phase, at which the volume of each of the retarded angle chambers 42 becomes the maximum, corresponds to a most retarded angle phase. On the other hand, a phase, at which the value of each of the advanced angle chambers 41 becomes the maximum, corresponds to a most advanced angle phase. In other words, the relative rotational phase is displaceable (changeable) between the most advanced angle phase and the most retarded angle phase.

As illustrated in FIG. 1, a torsion spring 103 is disposed between the inner rotor 3 and the front plate 22. The torsion spring 103 constantly biases the inner rotor 3 and the outer rotor 2 in a direction where the relative rotational phase is displaced in the advanced angle direction S1.

Figure 7:
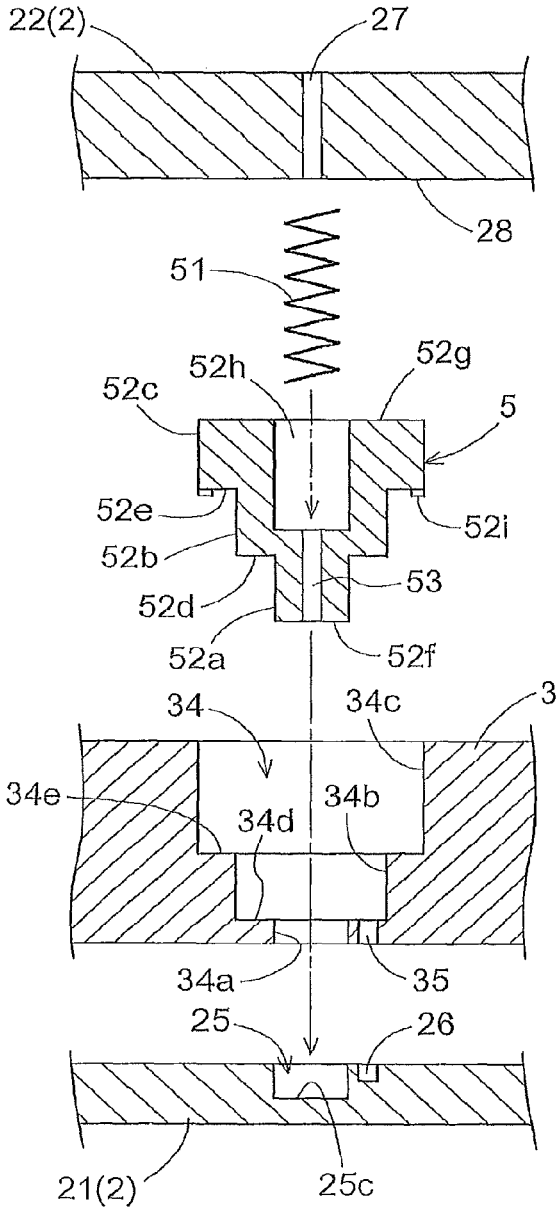
FIG. 7 is an exploded cross sectional diagram schematically illustrating a configuration example of each of a front plate, the restriction member, inner rotor and a rear plate.

Hereinbelow, the restriction member 5, the restriction recessed portion 25 and the like, which are configured so as to restrict the relative rotational phase to be displaced in a range (i.e. a restriction range) between the most advanced angle phase and the predetermined phase, which is set to be a phase between the most advanced angle phase and the most retarded angle phase, will be described in detail. Illustrated in FIGS. 3 to 6 are diagrams for explaining a state of each of the fluid chambers 4 and a state of the restriction member 5. More specifically, changes in the state of each of the fluid chambers 4 from when the engine is started to when the restriction member 5 is retracted from the restriction recessed portion 25 with time are illustrated in FIG. 3 through FIG. 6. An upper diagram in each of FIGS. 3A, 4A, 5A and 6A is an enlarged diagram schematically illustrating one of the fluid chambers 4 and its surrounding components. On the other hand, a bottom diagram in each of FIGS. 3A, 4A, 5A and 6A is an expanded cross sectional diagram illustrating the inner rotor 3, the restriction member 5 and the restriction recessed portion 25 along the relative rotational direction S. Illustrated in each of FIGS. 3B, 4B, 5B and 6B is a cross sectional view illustrating an inner surface of the rear plate 21 facing the inner rotor 3. Illustrated in FIG. 7 is an exploded cross sectional view in the radial direction illustrating configuration example of each of the front plate 22, the restriction member 5, the inner rotor 3 and the rear plate 21. Accordingly, illustrated in FIG. 7 is a diagram illustrating the restriction member 5 and the surrounding components being in an orthogonal relationship with each of the bottom diagrams in FIGS. 3A, 4A, 5A and 6A and the diagram illustrated in FIG. 7 are viewed in the same direction.

<Accommodation Portion>

As illustrated in FIG. 7, the accommodation portion 34 is defined by a bore portion, which is formed at the inner rotor 3 along a rotational axis of the camshaft 101 (which will be hereinafter referred simply to a rotational axis) so as to penetrate the inner rotor 3 from one surface of the inner rotor 3 facing the front plate 22 to the other one surface of the inner rotor 3 facing the rear plate 21. More specifically, the accommodation portion 34 has a shape, which is formed by connecting three cylindrical bores, which have different diameters from one another. Furthermore, the accommodation portion 34 is formed to have a slightly larger shape than a shape of the restriction member 5, so that the restriction member 5 is accommodated within the accommodation portion 34 while allowing the restriction member 5 to slide along the accommodation portion 34. The accommodation portion 34 includes a first inner circumferential portion 34*a*, which defines the cylindrical bore having the smallest diameter, a second inner circumferential portion 34*b*, which defines the cylindrical bore having a larger diameter than the cylindrical bore having the smallest diameter, a third inner circumferential portion 34*c*, which defines the cylindrical bore having the largest diameter, a first stepped portion 34*d* and a second stepped portion 34*e*.

<Restriction Member>

As illustrated in FIG. 7, the restriction member 5 has a shape, which is formed by piling three cylindrical portions (first, second and third cylindrical portions) having different diameters from one another. A recessed portion 52*h*, which is formed in a cylindrical shape, is formed at the restriction member 5 so as to extend in an axial direction of the restriction member 5 at a substantially center portion thereof. The restriction member 5 is formed to have a shape so that the diameter thereof at the first cylindrical portion, which faces the rear plate 21, becomes the smallest, the diameter of the restriction member 5 at the second cylindrical portion becomes larger than the diameter of the first cylindrical portion, and the diameter of the restriction member 5 at the third cylindrical portion, which faces the front plate 22, becomes the largest. The restriction member 5 includes a first outer circumferential portion 52*a*, which is an outer circumferential portion of the first cylindrical portion, a second outer circumferential portion 52*b*, which is an outer circumferential portion of the second cylindrical portion, a third outer cylindrical portion 52*c*, which is an outer circumferential portion of the third cylindrical portion, a first stepped portion 52*d*, a second stepped portion 52*e*, an end portion 52*f* and a base portion 52*g*. As described above, shapes of the first inner circumferential portion 34*a*, the second inner circumferential portion 34*b*, the third circumferential portion 34*c*, the first stepped portion 34*d* and the second stepped portion 34*e* of the accommodation portion 34 are formed so as to correspond to the first outer circumferential portion 52*a*, the second outer circumferential portion 52*b*, the third outer circumferential portion 52*c*, the first stepped portion 52*d* and the second stepped portion 52*e* of the restriction member 5, respectively, so that the restriction member 5 is accommodated within the accommodation portion 34 while allowing the restriction member 5 to slide along the accommodation portion 34.

An elongated protruding portion is formed at at least one of the first outer circumferential portion 52*a*, the second outer circumferential portion 52*b* and the third outer circumferential portion 52*c* so as to extend in a retracting direction of the restriction member 5. Further, a groove is formed at the accommodation portion 34 so as to correspond to the shape of the protruding portion formed at the restriction member 5. A length of the groove, which is formed on the accommodation portion 34, is set so as to be longer than a distance for the restriction member 5 to move (i.e. a moving distance of the restriction member 5) when being inserted/retracted into/from the restriction recessed portion 25. The restriction member 5 does not rotate relative to the accommodation portion 34 by the protruding portion being engaged with the groove. In other words, the protruding portion and the groove have a rotation restricting function. Alternatively, the protruding portion may be formed at the accommodating portion 34 and the groove may be formed at the restriction member 5. Further, the rotation restricting function is not limited to the engagement between the protruding portion and the groove. However, the rotation restricting function needs to be configured so as not to interrupt the inserting and retracting movement of the restriction member 5 relative to the restriction recessed portion 25.

<Restriction Recessed Portion>

Figure 3A:
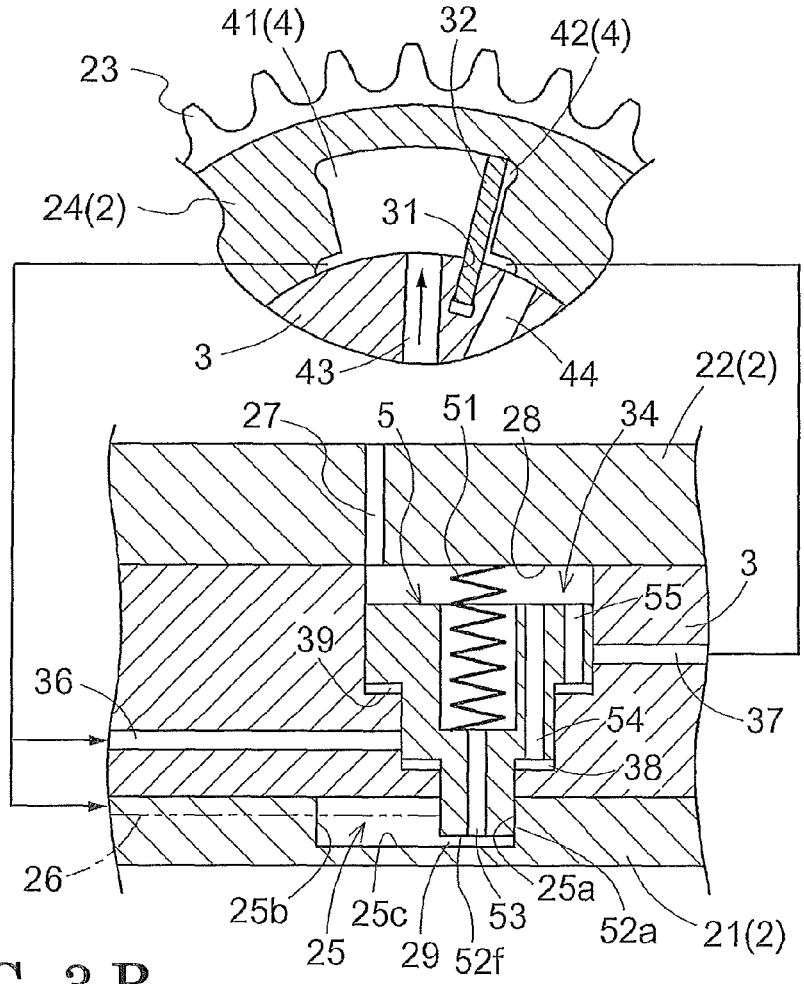
FIG. 3 is a diagram for explaining states of a fluid pressure chamber, a restriction member and each passage in a case where a relative rotational phase is retained at a most advanced angle phase.
Figure 3B:
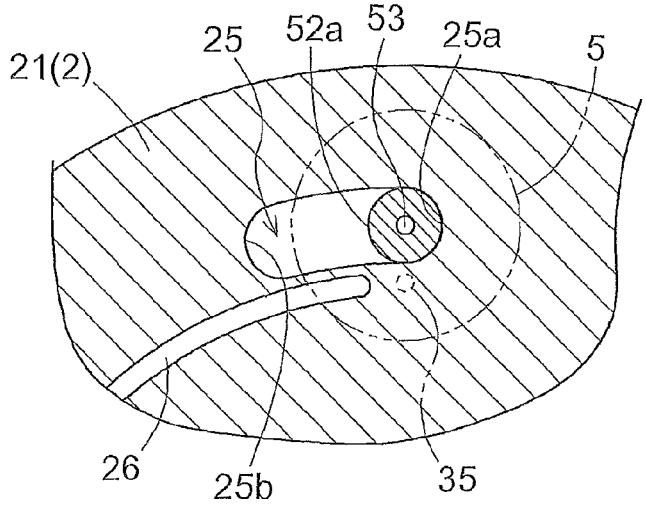
Figure 4A:
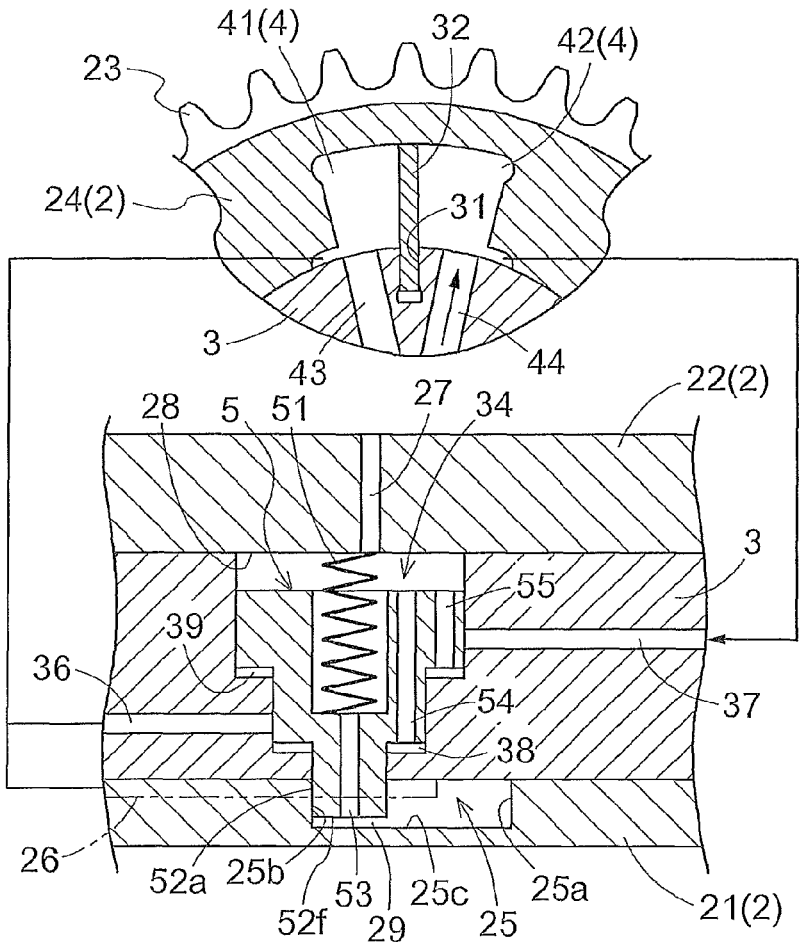
FIG. 4 is a diagram for explaining the states of the fluid pressure chamber, the restriction member and each passage in a case where the relative rotational phase is retained at an intermediate restriction phase.
Figure 4B:
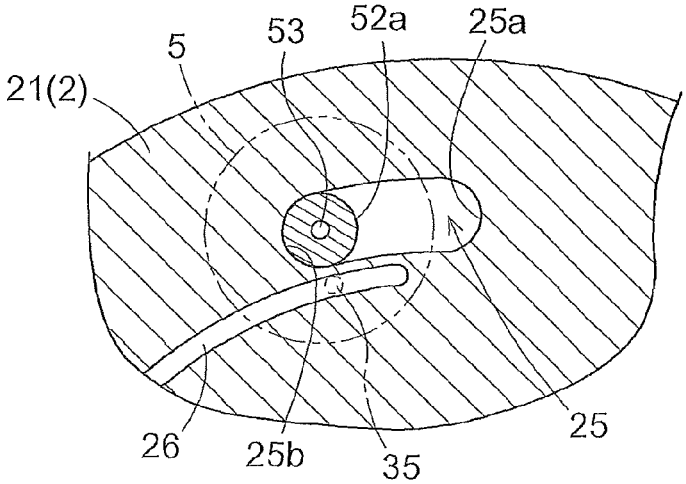
Figure 5A:
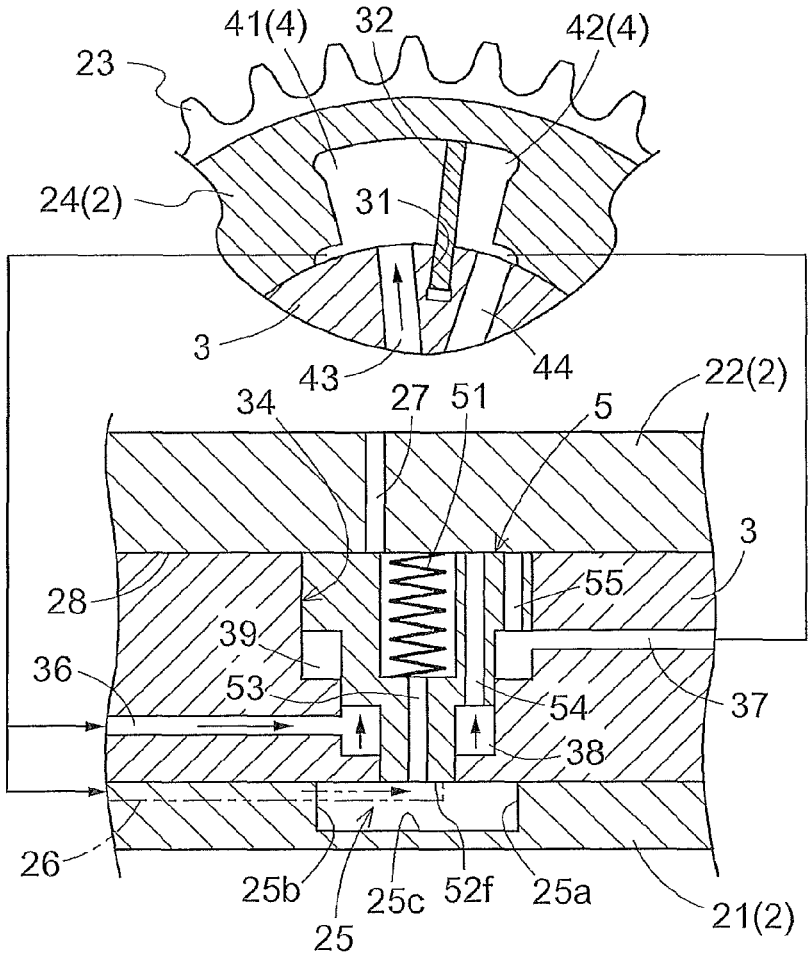
FIG. 5 is a diagram for explaining the states of the fluid pressure chamber, the restriction member and each passage in a case where a restricted state is cancelled.
Figure 5B:
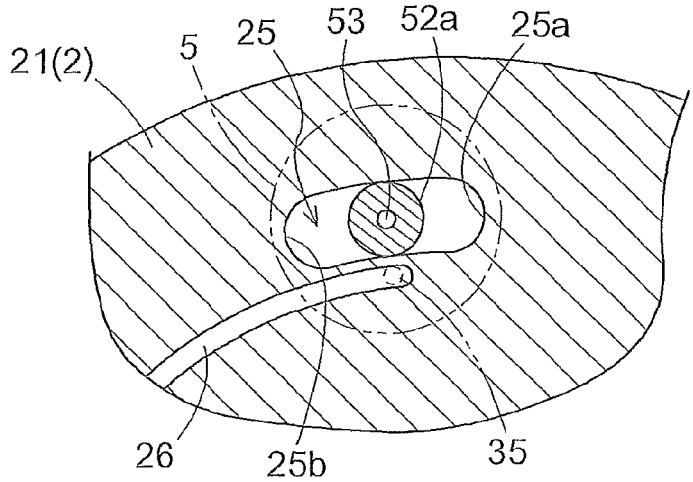
Figure 6A:
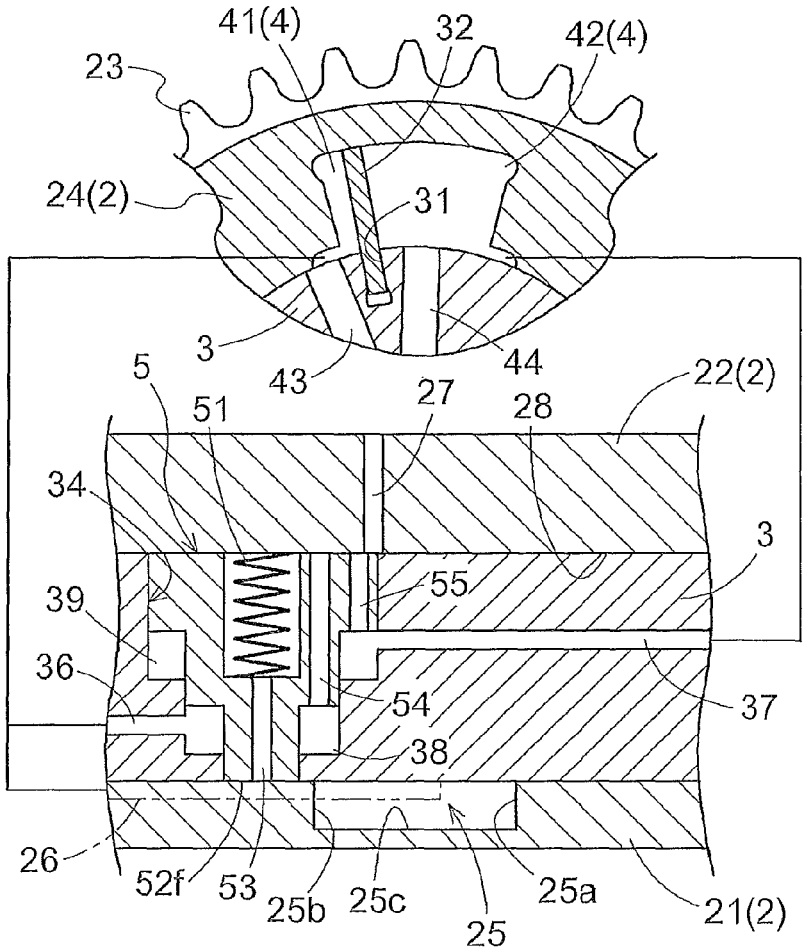
FIG. 6 is a diagram for explaining the sates of the fluid pressure chamber, the restriction member and each passage in a case where an unrestricted state is established.
Figure 6B:
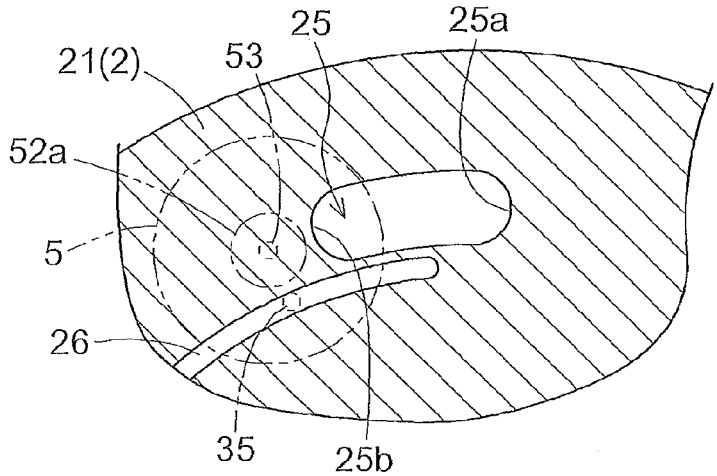

As illustrated in FIG. 3B and FIG. 7, the restriction recessed portion 25 is an elongated groove formed at the surface of the rear plate 21 facing the inner rotor 3. Further, the restriction recessed portion 25 is formed in an arc shape having the rotational axis as a center point. More specifically, the restriction recessed portion 25 is formed with a first end portion 25*a*, a second end portion 25*b*, a base portion 25*c* and side portions extending along a longitudinal direction of the restriction recessed portion 25.

<Relationship Among Accommodating Portion, Restriction Member and Restriction Recessed Portion>

As illustrated in FIG. 3A, the restriction member 5 is provided within the accommodation portion 34. Furthermore, the restriction member 5 is normally biased by a spring 51, which is provided at the recessed portion 52*h* of the restriction member 5, so that the end portion 52*f* thereof is inserted into the restriction recessed portion 25. A depth of the restriction recessed portion 25 is set so that the end portion 52*f* of the restriction member 5 does not contact the base portion 25*c* of the restriction recessed portion 25 and so that a clearance 29 is formed therebetween when the restriction member 5 is inserted into the restriction recessed portion 25. The clearance 29 formed between the end portion 52*f* of the restriction member 5 and the base portion 25*c* of the restriction recessed portion 25 indicates a clearance between the restriction member 5 and the restriction recessed portion 25. When the end portion 52*f* of the restriction member 5 is inserted into the restriction recessed portion 25, the relative rotational phase is restricted within the restriction range, thereby establishing the restricted state. On the other hand, when the end portion 52*f* of the restriction member 5 is retracted from the restriction recessed portion 25 so as to resist against a biasing force generated by the spring 51, the restricted state is cancelled, thereby establishing the unrestricted state.

As illustrated in FIG. 3, the restriction recessed portion 25 is formed so that a phase, which is formed between the outer rotor 2 and the inner rotor 3 when the first outer circumferential portion 52*a* of the restriction member 5 contacts the first end portion 25*a* of the restriction recessed portion 25, corresponds to the most advanced angle phase. Further, as illustrated in FIG. 4, the restriction recessed portion 25 is formed so that a phase, which is formed when the first outer circumferential portion 52*a* of the restriction member 5 contact the second end portion 25*b* of the restriction recessed portion 25, corresponds to the predetermined phase between the most advanced angle phase and the most retarded angle phase. Hereinbelow, the phase corresponding to the predetermined phase will be referred to as an intermediate restriction phase. Accordingly, displacement of the relative rotational phase between the outer rotor 2 and the inner rotor 3 is restricted within the range between the most advanced angle phase and the intermediate restriction phase (i.e. the restricted state is established) in the case where the restriction member 5 is inserted into the restriction recessed portion 25.

As illustrated in FIG. 3, the restriction member 5 and the accommodation portion 34 are configured so as to form slight clearances between the first stepped portion 52*d* of the restriction member 5 and the first stepped portion 34*d* of the accommodation portion 34, and between the second stepped portion 52*e* of the restriction member 5 and the second stepped portion 34*e* of the accommodation portion 34 while the restriction member 5 is inserted into the restriction recessed portion 25. More specifically, for example, a spacer portion 52*i* is provided at the second stepped portion 52*e* of the restriction member 5, as illustrated in FIG. 7. In a case where plural spacer portions 52*i* are provided at the second stepped portion 52*e* of the restriction member 5 so as to be equally spaced therebetween in a circumferential direction thereof, the spacer portions 52*i* evenly contact at least one of the first stepped portion 34*d* and the second stepped portion 34*e* of the accommodation portion 34, thereby stably supporting the restriction member 5 within the accommodation portion 34.

As illustrated in FIGS. 3 and 7, a clearance 38 is formed in a circular shape between the first outer circumferential portion 52*a* and the first stepped portion 52*d* of the restriction member 5 on the one hand and the second inner circumferential portion 34*b* and the first stepped portion 34*d* of the accommodation portion 34 on the other. Additionally, the clearance 38 is also referred to as a first clearance, a second clearance, a clearance between the accommodation portion and the stepped portion of the restriction member, and a clearance formed between the restriction member 5 and the accommodation portion 34. Furthermore, a clearance 39 is formed in a circular shape between the second outer circumferential portion 52*b* and the second stepped portion 52*e* of the restriction member 5 on the one hand and the third inner circumferential portion 34*c* and the second stepped portion 34*e* of the accommodation portion 34 on the other. Additionally, the clearance 39 is also referred to as a third clearance, a clearance between the accommodation portion 34 and the stepped portion of the restriction member 25 and a clearance formed between the restriction member 5 and the accommodation portion 34.

<Restriction Cancellation Passage>

The restriction cancellation passage includes a first passage 26 and a second passage 35. As illustrated in FIGS. 3 and 7, the first passage 26 is formed at the surface of the rear plate 21 facing the inner rotor 3. As is the case with the restriction recessed portion 25, the first passage 26 is an elongated groove formed in an arc shape having the rotational axis as a center point. Furthermore, the first passage 26 is configured so that one end portion thereof communicates with one of the advanced angle chambers 41 in response to the rotational movement of the inner rotor 3 relative to the outer rotor 2. More specifically, the first passage 26 is configured so as to be in communication with one of the advanced angle chambers 41 at the one end portion of the first passage 26 at least when the restricted state is established. The other end portion of the first passage 26 is extended to the vicinity of the restriction recessed portion 25, while avoiding a communication with the restriction recessed portion 25.

As illustrated in FIGS. 3B and 7, the second passage 35 is a bore, which is formed at the inner rotor 3 so as to extend along the rotational axis. Furthermore, the second passage 35 is configured so as to penetrate through the inner rotor 3 from the first stepped portion 34*d* of the accommodation portion 34 to a surface of the inner rotor 3 facing the rear plate 21 so as to open to the accommodation portion 34. In other words, the second passage 35 is configured so as to connect the first passage 26 and the clearance 38 in order to establish the communication therebetween in response to the relative rotational displacement between the outer rotor 2 and the inner rotor 3.

The arc shape of the first passage 26 is configured so as to correspond to a moving path of the second passage 35 to be formed when the second passage 35 is rotatably displaced relative to the rear plate 21 together with the inner rotor 3. A position of the second passage 35 relative to the first passage 25 is displaced along the relative rotational direction S so as to establish the communication (i.e. a spatial communication, a fluid communication) between the first passage 26 and the second clearance 38 and so as not to establish the communication therebetween in response to the relative rotation between the outer rotor 2 and the inner rotor 3. More specifically, as illustrated in FIG. 5, when the second passage 35 is connected to the first passage 26 while the restricted state is established, the accommodation portion 34 becomes in communication with the one of the advanced angle chambers 41. When the operation oil is supplied to the advanced angle chambers 41 while the accommodation portion 34 and one of the advanced angle chambers 41 communicate with each other, the operation oil is also supplied to the clearance 38 via the first passage 26 and the second passage 35. Then, the first stepped portion 52*d* of the restriction member 5 is pressed towards the front plate 22 by an oil pressure (i.e. a hydraulic pressure) of the operation oil. Accordingly, the restriction member 5 is slid along the accommodation portion 34 to be retracted from the restriction recessed portion 25, thereby establishing the unrestricted state. Additionally, the retraction of the restriction member 5 is restricted by the base portion 52*g* of the restriction member 5 contacting an inner surface 28 of the front plate 22.

As illustrated in, at least, FIG. 3, a length of the first passage 26 is set so as not to be connected to the second passage 35 in a case where the first outer circumferential portion 52*a* of the restriction member 5 approaches the first end portion 25*a* of the restriction recessed portion 25, i.e. in the case where the relative rotational phase is displaced to a phase in the vicinity of the most advanced angle phase. A range in which the second passage 35 is not connected to the first passage 26, i.e. an extended point of the other end portion of the first passage 26 positioned so as to correspond to the intermediate restriction phase, may be changed as long as the extended point of the other end portion of the first passage 26 is positioned within the restriction range and so as to be positioned to correspond to the intermediate restriction phase relative to the most advanced phase.

The restriction recessed portion 25 is normally closed by the inner rotor 3. As described above, because the second passage 35 is configured so as to connect the first passage 26 and the clearance 38, the operation oil is not likely to be supplied to the restriction recessed portion 25. Accordingly, the operation oil does not flow into the restriction recessed portion 25, therefore, the movement of the restriction member 5 within the restriction recessed portion 25 is not interrupted by the operation oil.

<First Retaining Passage and Second Retaining Passage>

As illustrated in FIG. 5, the inner rotor 3 includes a first retaining passage 36 and a second retaining passage 37. The accommodation portion 34 and one of the advanced angle chambers 41 are in communication with each other at the second inner circumferential portion 34*b* via the first retaining passage 36 (see also FIG. 7). The accommodation portion 34 and one of the retarded angle chambers 42 are in communication with each other at the third inner circumferential portion 34*c* via the second retaining passage 37 (see also FIG. 7). Paths of the first and second retaining passages 36 and 37 may be changed in view of processability as long as the first and second retaining passages 36 and 37 have the above-described configuration.

As illustrated in FIG. 3, an end portion of the first retaining passage 36, which is connected to the accommodation portion 34, is closed by the second outer circumferential portion 52*b* of the restriction member 5 when the restriction member 5 is inserted into the restriction recessed portion 25 (see also FIG. 7). On the other hand, as illustrated in FIG. 5, the end portion of the first retaining passage 36 connected to the accommodation portion 34 is opened towards the clearance 38 so as to establish the communication therebetween when the restriction member 5 is retracted from the restriction recessed portion 25. As illustrated in FIG. 3, an end portion of the second retaining passage 37, which is connected to the accommodation portion 34, is closed by the third outer circumferential portion 52*c* of the restriction member 5 when the restriction member 5 is inserted into the restriction recessed portion 25 (see also FIG. 7). On the other hand, as illustrated in FIG. 5, the end portion of the second retaining passage 37 connected to the accommodation portion 34 is opened towards the clearance 39 so as establish the communication therebetween when the restriction member 5 is retracted from the restriction recessed portion 25. In other words, when the restriction member 5 is retracted from the restriction recessed portion 25, one of the advanced angle chambers 41 and the clearance 38 become in communication with each other via the first retaining passage 36, and one of the retarded angle chambers 42 and the clearance 38 become in communication with each other via the second retaining passage 37. A clearance (the clearance 38) connected to one of the advanced angle chambers 41 via the first retaining passage 36 differs from a clearance (the clearance 39) connected to one of the retarded angle chambers 42 via the second retaining passage 37.

The operation oil is supplied either to the advanced angle chambers 41 or to the retarded angle chambers 42 while the engine is normally driven. Therefore, once the unrestricted state is established, the operation oil is supplied either to the clearance 38 or to the clearance 39. Accordingly, either one of the first stepped portion 52*d* and the second stepped portion 52*e* of the restriction member 5 is pressed in the retracting direction by the oil pressure of the operation oil, thereby retaining the restriction member 5 at a retracted state. Hence, once the unrestricted state is established, the unrestricted state is maintained while the engine is normally driven. Additionally, as described above, the clearance 38 and the clearance 39 are formed at different stepped portions between the restriction member 5 and the accommodation portion 34, therefore, the clearance 38 and the clearance 39 do not normally communicate with each other. In other words, one of the advanced angle chambers 41 and one of the retarded angle chambers 42 do not communicate with each other via the clearances 38 and 39.

When the restriction member 5 starts retracting from the restriction recessed portion 25 and the clearance 38 and the first retaining passage 36 start communicating with each other, the retracting movement of the restriction member 5 is assisted by the oil pressure of the operation oil, which is supplied to the clearance 38 when the communication between the first passage 26 and the second passage 35 is established. Accordingly, the restriction member 5 is surely retracted from the restriction recessed portion 25.

<Leak Passage>

The valve timing control device 1 includes a leak passage for opening the clearance 29, the clearance 38 and the clearance 39 to the atmosphere only while the restricted state is established. As illustrated in FIG. 3, the leak passage is configured with a first leak passage 53, a second leak passage 54 and a third leak passage 55, which are formed at the restriction member 5, and a fourth leak passage 27. The first leak passage 53 penetrates the restriction member 5 from the end portion 52*f* to the recessed portion 52*h*. The second leak passage 54 penetrates the restriction member 5 from the first stepped portion 52*d* to the base portion 52*g*. The third leak passage 55 penetrates the restriction member 5 from the second stepped portion 52*e* to the base portion 52*g*. Furthermore, the fourth leak passage 27 for opening the accommodation portion 34 to the atmosphere is provided at the front plate 22. More specifically, the fourth leak passage 27 penetrates the front plate 22 from a portion of the front surface 28 of the front plate 22 corresponding to the accommodation portion 34 to the atmosphere.

In a case where the operation oil is supplied to the advanced angle chambers 41 as indicated by an arrow at an upper diagram of FIG. 3A while the restricted state is established, the operation oil is supplied to the first retaining passage 36, however, the operation oil is not supplied to the accommodation portion 34 because the end portion of the first retaining passage 36 connected to the accommodation portion 34 is closed by the restriction portion 5. However, because a slight clearance is formed between the second inner circumferential portion 34*b* of the accommodation portion 34 and the second outer circumferential portion 52*b* of the restriction member 5, the operation oil may leak to the clearance 38 or to the clearance 39 from the first retaining passage 36.

Additionally, as illustrated in FIG. 3B, because the first passage 26 is formed in the vicinity of the restriction recessed portion 25, the operation oil may leak to the clearance 29 formed between the restriction member 5 and the restriction recessed portion 25 from the first passage 26, which communicates with one of the advanced angle chamber 41, in the case where the operation oil is supplied to the advanced angle chambers 41 while the restricted state is established. If a large amount of the operation oil leaks to the clearance 29, the clearance 38 or the clearance 39, the oil pressure of the operation oil may act on the end portion 52*f*, the first stepped portion 52*d* or the second stepped portion 52*e* of the restriction member 5, which may result in improperly operating the restriction member 5 and unexpectedly retracting the restriction member 5 from the restriction recessed portion 25. Even in this case, because the first leak passage 53, the second leak passage 54, the third leak passage 55 and the fourth leak passage 27 are provided to the valve timing control device 1, the operation oil is discharged outside of the valve timing control device 1, thereby reducing a possibility of the restriction member 5 being improperly operated and being unexpectedly retracted from the restriction recessed portion 25.

For example, in the case where the most advanced angle phase is established as illustrated in FIG. 3, the operation oil, which leaks from the first retaining passage 36 to the clearance 38 or the clearance 39, is discharged outside the valve timing device 1 via the second leak passage 54 or the third leak passage 55 and further, via the fourth leak passage 27. On the other hand, the operation oil, which leaks from the first passage 26 to the clearance 29, is discharged outside the valve timing device 1 via the first leak passage 53, the recessed portion 52*h* and the fourth leak passage 27. In the case where the operation oil is supplied to the retarded angle chambers 42 as indicated by an arrow at the upper diagram of FIG. 4A while the restricted state is established, the operation oil, which leaks from the second retaining passage 37 to the clearance 39, is discharged outside the valve timing device 1 via the third leak passage 55 and the fourth leak passage 27. Therefore, the restricted state is surely maintained when necessary while avoiding the restriction member 5 to be improperly operated.

After the restriction member 5 is retracted from the restriction recessed portion 25, the base portion 52*g* of the restriction member 5 contacts the inner surface 28 of the front plate 22. Accordingly, the second leak passage 54, the third leak passage 55 and the fourth leak passage 27 are closed. In FIG. 6, it is described as if the third leak passage 55 and the fourth leak passage 27 are in communication. However, FIG. 6 is the diagram for explaining an operation of the valve timing control device 1, and in reality, the fourth leak passage 27 is formed at the outer rotor 2 so as not to be in communication with the second leak passage 54 and the third leak passage 55 in the state illustrated in FIG. 6. A size of each of the first, second, third and fourth leak passages 53, 54, 55 and 27 is determined in a size by which the leaked operation oil is dischargeable to the atmosphere.

<Lock Mechanism>

As illustrated in FIG. 2, the valve timing control device 1 includes a lock mechanism 6. The lock mechanism 6 is a mechanism for locking the relative rotational phase at the most advanced angle phase. The lock mechanism 6 includes a lock passage 61, a lock groove 62, a lock member 63, which is configured so as to be insertable/retractable into/from the lock groove 62, and a retarded angle chamber connecting passage 65. The lock passage 61 and the lock grove 62 are formed on the inner rotor 3. The retarded angle chamber connecting passage 65 is a groove, which is formed at an outer circumferential surface of the inner rotor 3 facing the outer rotor 2 so as to connect one of the neighboring retarded angle chambers 42 and the lock passage 61. The lock member 63 is normally biased by a spring 64 so as to be inserted into the lock groove 62. When the lock member 63 is inserted into the lock groove 62, the relative rotational phase is locked at the most advanced angle phase. On the other hand, when the lock member 63 is retracted from the lock groove 62, the locking of the relative rotational phase at the most advanced angle phase is cancelled, thereby allowing the relative rotational phase to be displaced. However, even if the lock member 63 is retracted from the lock groove 62, the restricted state is maintained while the restriction member 5 is being inserted into the restriction recessed portion 25, and the relative rotational phase is restricted within the above mentioned restriction range.

The lock passage 61 serves also as a retarded angle passage 44. When the operation oil is supplied to the retarded angle chambers 42, the operation oil is also supplied to the lock passage 61. Accordingly, the lock member 63 is pressed in a retracting direction by the oil pressure of the operation oil. When the oil pressure of the operation oil acting on the lock member 63 becomes greater than a biasing force generated by the spring 64, the lock member 63 starts being retracted from the lock groove 62. After the lock member 63 is retracted from the lock groove 62, the lock passage 61 becomes in communication with the retarded angle chamber connecting passage 65, so that the operation oil is supplied to one of the neighboring retarded angle chambers 42 from the lock passage 61 via the retarded angle chamber connecting passage 65. Once the lock member 63 is retracted from the lock groove 62, the lock member 63 is retained at a retracted state (i.e. a state where the lock member 63 is retracted from the lock groove 62) by a centrifugal force generated when the outer rotor 2 and the inner rotor 3 rotate relative to each other. When a number of rotations (a rotational speed) of the engine decreases and the centrifugal force becomes less than the biasing force generated by the spring 64, the lock member 63 is again biased by the spring 64 in a direction by which the lock member 63 is inserted into the lock groove 62. In other words, when the relative rotational phase forms the most advanced angle phase, the lock member 63 is inserted into the lock groove 62. On the other hand, in a case where the relative rotational phase does not form the most advanced angle phase, an inner end portion of the lock member 63 in the radial direction only contacts the outer circumferential surface of the inner rotor 3, but the lock member 63 does not lock the relative rotational phase.

<Operation Fluid Supply and Discharge Mechanism>

A configuration of the operation fluid supply and discharge mechanism 7 will be described below. As illustrated in FIG. 1, the operation fluid supply and discharge mechanism 7 includes a pump 71, a flow switching valve 72 and an oil pan 73. The pump 71 is driven by the engine and supplies the operation oil to the advanced angle chambers 41 or to the retarded angle chambers 42. The flow switching valve 72 controls the supply and discharge of the operation oil relative to the advanced angle passages 43 and the retarded angle passages 44. The oil pan 73 stores therein the operation oil.

The pump 71 is a mechanical hydraulic pump, which is driven by receiving the driving force of the crankshaft of the engine. The pump 71 absorbs the operation oil stored in then oil pan 73 and discharges the operation oil to a downstream side of a flow of the operation oil.

The flow switching valve 72 is operated on the basis of a control of a power supply executed by an engine control unit 8 (which will be hereinafter referred to as an ECU 8). The flow of the operation oil is changed by a switching operation by the flow switching valve 72 and a control by the pump 71. More specifically, the flow of the operation oil is changed either to: supply the operation oil to the advanced angle chambers 41 and discharge the operation oil from the retarded angle chambers 42; discharge the operation oil from the advanced angle chambers 41 and supply the operation oil to the retarded angle chambers 42; or to cut off the supply of the operation oil to the advanced angle chambers 41 and the retarded angle chambers 42. The control of the operation oil so as to supply the operation oil to the advanced angle chambers 41 and discharge the operation oil from the retarded angle chambers 42 is referred to as an advanced angle control. When the advanced angle control is executed, the vanes 32 are rotatably displaced relative to the outer rotor 2 in the advanced angle direction S1. Accordingly, the relative rotational phase is displaced so as to form an advanced angle phase (which will be hereinafter expressed also as "the relative rotational phase is displaced towards the advanced angle phase). In this embodiment, a range of the advanced angle phase corresponds to a range between a position where each vane 32 is positioned so as to form the intermediate restriction phase and a position where each vane 32 is positioned so as to form the most advanced angle phase. The control of the operation oil so as to discharge the operation oil from the advanced angle chambers 41 and supply the operation oil to the retarded angle chambers 42 is referred to as a retarded angle control. When the retarded angle control is executed, the vanes 32 are rotatably displaced relative to the outer rotor 2 in the retarded angle direction S2, thereby displacing the relative rotational phase to form a retarded angle phase (which will be hereinafter expressed also as "the relative rotational phase is displaced towards the retarded angle phase). In this embodiment, a range of the retarded angle phase corresponds to a range between the position where each vane 32 is positioned so as to form the intermediate restriction phase and a position where each vane 32 is positioned so as to form the most retarded angle phase. When the control of cutting off the supply of the operation oil to the advanced angle chambers 41 and the retarded angle chambers 42 is executed, the vanes 32 is not rotatably displaced relative to the outer rotor 2, thereby retaining the relative rotational phase at an appropriate phase.

In this embodiment, when the power supply is turned on, the flow switching valve 72 is displaced to the left in FIG. 1. Accordingly, an operation oil flow, by which the retarded control is executable, is established. On the other hand, when the power supply is turned off, the flow switching valve 72 is displaced to the right in FIG. 1. Accordingly, an operation oil flow, by which the advanced angle control is executable, is established.

Further, in this embodiment, the power supply to the flow switching valve 72 may be controlled by changing a duty ratio in order to control the supply of the operation oil to the advanced angle chambers 41 and the retarded angle chambers 42 and the discharge of the operation oil from the advanced angle chambers 41 and the retarded angle chambers 42.

<Operation of Valve Timing Control Device>

An operation example of the valve timing control device 1 in a case where the engine is started while the relative rotational phase is retained at the most advanced angle phase will be described below.

While the engine is stopped (i.e. an engine stopped state), the pump 71 is not driven (i.e. the pump 71 is stopped). The power supply to the flow switching valve 72 is turned off while the engine is stopped. Accordingly, the operation passage, by which the advanced angle control is executable, remains to be established. As illustrated in FIG. 2, in this case, the lock member 63 is inserted into the lock groove 62, so that the relative rotational phase is locked at the most advanced angle phase. Further, in this case, as illustrated in FIG. 3, the restriction member 5 reminds to be inserted into the restriction recessed portion 25.

Once a starting control of the engine is started, a cranking occurs. The pump 71 is actuated by the cranking. However, the power supply to the flow switching valve 72 remains to be turned off. Furthermore, the operation oil passage by which the advanced angle phase control is executable is still being established. Therefore, the operation oil is not supplied to the lock mechanism 6. Accordingly, the locking state of the relative rotational phase by the lock mechanism 6 is maintained.

When the engine is started by the cranking, the ECU 8 executes the advanced angle control and the operation oil is supplied to the advanced angle passages 43 from the operation fluid supply and discharge mechanism 7. In this case, the operation oil is not supplied to the lock passage 61, therefore, the lock member 63 remains being inserted into the lock groove 62. Further, even if the operation oil is supplied to the first passage 26 from one of the advanced angle chambers 41 as indicated by an arrow in FIG. 3A, because the first passage 26 does not communicate with the second passage 35, the restriction member 5 remains at the state where the restriction member 5 being inserted into the restriction recessed portion 25, thereby maintaining the restricted state. In this case, because the valve timing control device 1 includes the leak passage, the improper operation of the restriction member 5 may be avoided.

Accordingly, the relative rotational phase when the engine is started is locked at the most advanced angle phase. When the relative rotational phase is displaced to form the most advanced angle phase, the exhaust valves are opened in an ignition process of the engine and are closed in an emission process of the engine. Some of exhaust gas, which is not emitted, is compressed in the emission process. Therefore, when air intake valves are opened, the compressed exhaust gas flows back to an intake port. When the engine is started while the relative rotational phase forms the most advanced angle phase, intake air temperature rises due to high temperature of the exhaust gas. As a result, atomization of fuel is facilitated. Accordingly, even when the engine is started while the engine is cold (i.e. a cold start), an occurrence of hydrocarbon (i.e. cold HC) may be restricted (reduced).

In the case where the valve timing control device 1, which is adapted to the exhaust valves, establishes the most advanced angle phase, the above described advantaged and effects are achieved. However, in this case, a relatively large load may be applied to the engine. As a result, an output torque generated by the engine may decrease, which may result in deteriorating an efficiency of fuel consumption. Therefore, in this embodiment, the relative rotational phase is displaced towards the retarded angle phase after a few seconds have passed since the engine had started.

When the ECU 8 executes the retarded angle control, the operation oil is supplied to the retarded angle passages 44 and the lock passage 61 from the operation fluid supply and discharge mechanism 7. Once the oil pressure reaches a predetermined oil pressure, the lock member 63 is retracted from the lock groove 62, thereby canceling the locking state (i.e. a state where the relative rotational phase is locked at the most advanced angle phase) by the lock mechanism 6, as described above.

After the locking state by the lock mechanism 6 is cancelled, the relative rotational phase starts being displaced in the retarded angle direction S2. As illustrated in FIG. 4, during a process where the relative rotational phase is displaced to the intermediate restriction phase, the first passage 26 becomes in communication with the second passage 35. However, in this case, because the retarded angle control is executed, the operation oil is not supplied to the advanced angle chambers 41. As a result, the restriction member 5 remains being inserted into the restriction recessed portion 25 (i.e. the restricted state). Furthermore, in this case, the operation oil is supplied also to the second retaining passage 37 from one of the retarded angle chambers 42. However, as described above, the end portion of the second retaining passage 37 connected to the accommodation portion 34 is blocked by the restriction member 5. Furthermore, even if the operation oil leaks to the clearance 39 from the second retaining passage 37, the leaked operation oil is discharged outside the valve timing control device 1 via the third leak passage 55 and the fourth leak passage 27. Accordingly, chances of the restriction member 5 being improperly operated may be reduced. Hence, the first outer cylindrical portion 52*a* of the restriction member 5 contacts the second end portion 25*b* of the restriction recessed portion 25, thereby restricting the restriction member 5 being displaced towards the retarded angle phase so as to exceed the intermediate restriction phase (i.e. the restriction member 5 is restricted so as not to be displaced to form the retarded angle phase). In this case, a position of the restriction member 5 is determined by the restriction member 5 being pressed against the second end portion 25*b* of the restriction recessed portion 25 by the biasing force generated towards the retarded angle phase in the retarded angle control. In other words, the relative rotational phase is restricted at the intermediate restriction phase.

The intermediate restriction phase is a phase between the most advanced angle phase and the most retarded angle phase. Moreover, the intermediate restriction phase is not limited to a specific phase. In a case where the engine is started in a cold region (i.e. under a cold temperature), a temperature of the operation oil tends to remain cold for a few seconds after the engine has started. Accordingly, the operation oil may have high viscosity and may lack in oil mobility. Therefore, it may be difficult to retain the relative rotational phase at a desired phase by using the oil pressure of the operation oil. Hence, in this case, the operation fluid supply and discharge mechanism 7 needs to increase an oil pumping pressure in order to displace the relative rotational phase towards the retarded angle phase. Therefore, the relative rotational phase may unexpectedly reach the most retarded angle phase in the case where the oil pumping pressure generated by the operation fluid supply and discharge mechanism 7 is increased. In this case, the exhaust valves are supposed to be opened even in a process of air intake. In a case where the Atkinson cycle (Miller cycle) is adapted to the valve timing control device 1, which is provided at the exhaust valves, while the engine idles after the engine is started, the air may be taken via the exhaust valves in the air intake process, which may result in deteriorating advantages and effects obtained by using the Atkinson cycle. However, according to the valve timing control device 1 of the first embodiment, the advantages and effects obtained by using the Atkinson cycle are fully utilized because the relative rotational phase is restricted at the intermediate restriction phase.

In a case where the relative rotational phase is to be further displaced in the retarded angle direction S2 from the intermediate restriction phase, the restriction member 5 needs to be turned to the unrestricted state. Hence, the ECU 8 executes the advanced angle control in order to return the restriction member 5 to the position at which the advanced angle phase is formed. In this case, as illustrated in FIG. 5, the first passage 26 and the second passage 35 communicate with each other, therefore, the operation oil is supplied to the clearance 38 by the advanced angle control. When the oil pressure of the operation oil acting on the first stepped portion 52*d* of the restriction member 5 becomes greater than the biasing force generated by the spring 51, the restriction member 5 retracts from the restriction recessed portion 25, thereby establishing the unrestricted state. In order not to interrupt the communication between the first passage 26 and the second passage 35 when the displacement of the relative rotational phase in the advanced angle direction S1, the first passage 26 is formed so as to extend towards the retarded angle phase with allowance. Once the restriction member 5 is retracted from the restriction recessed portion 25, the operation oil is also supplied to the accommodation portion 34 from the first retaining passage 36, therefore, the retracted state of the restriction member 5 is surely maintained.

The operation oil is supplied either to the advanced angle chambers 41 or to the retarded angle chambers 42 while the engine is being driven. Therefore, after the unrestricted state is established, the operation oil is supplied either to the clearance 38 or to the clearance 39, thereby maintaining the retracted state of the restriction member 5 and maintaining the unrestricted state. Accordingly, the relative rotational phase is displaceable within a range between the most advanced angle phase and the most retarded angle phase in response to the rotational number of the engine and the load applied to the engine.

When the engine is stopped, the ECU 8 executes the advanced angle control in order to displace the relative rotational phase to the most advanced angle phase in preparation for the engine being started again. Then, when the engine is completely stopped and the operation oil within the advanced angle chambers 41 and the retarded angle chambers 42 is discharged under the above-mentioned state, the oil pressure applied to the clearances 38 and 39 decreases, accordingly, the restriction member 5 is inserted into the restriction recessed portion 25 by the biasing force generated by the spring 51. In this case, the operation oil is not supplied to the lock passage 61, therefore, the oil pressure is not applied to the lock member 63. As a result, the lock member 63 is inserted into the lock groove 62. Accordingly, the engine is started again in the state where the relative rotational phase is retained at the most advanced angle phase.

As described above, each of the clearances 38 and 39 is formed in the circular shape. The first stepped portion 52*d* of the restriction member 5 is a surface, which is formed to be orthogonal to the retracting direction of the restriction member 5. Therefore, the oil pressure of the operation oil evenly acts on the entire first stepped portion 52*d* of the restriction member 5 in the retracting direction. Accordingly, the restriction member 5 is smoothly retracted from the restriction recessed portion 25 and the retracted state of the restriction member 5 is stably maintained. Furthermore, the chances of the restriction member 5 being improperly operated by the restriction member 5 jouncing (e.g. due to a backlash of the restriction member 5) when being retracted from the restriction recessed portion 25 may be reduced.

In the process of the restriction member 5 being retracted from the restriction recessed portion 25, a state where the clearance 38 being opened to the atmosphere via the second leak passage 54 is maintained. However, as a large amount of the operation oil supplied to the clearance 38 as the amount of the operation oil being discharged outside the valve timing control device 1 is negligible, the leakage of the operation oil outside the valve timing control device 1 does not influence the operation of the restriction member 5 being retracted from the restriction recessed portion 25.

As illustrated in FIG. 6, in the state where the restriction member 5 is being retracted from the restriction recessed portion 25, the clearance 38, which is in communication with one of the advanced angle chambers 41, and the clearance 39, which is in communication with one of the retarded angle chambers 42, are positioned close to each other. Therefore, leakage of the operation oil from the clearance 38 to the clearance 39 and vice versa needs to be restricted. Accordingly, sizes of the restriction member 5 and the accommodation portion 34 need to be determined so that a contacting area between the second cylindrical portion 52*b* of the restriction member 5 and the second inner circumferential portion 34*b* of the accommodation portion 34 becomes relatively large.

The valve timing control device 1 of the first embodiment may be adapted to the air intake valves. In this case, the description "advanced angle" in the first embodiment should be replaced with the "retarded angle", and similarly, the description "retarded angle" in the first embodiment should be replaced with the "advanced angle".

The shapes and sizes of the restriction member 5 and the accommodation portion 34 are not limited to the above-described shapes and sizes. The shapes and sizes of the restriction member 5 and the accommodation portion 34 may be changed to have any desired shape and size as long as the restriction member 5 and the accommodation portion 34 are configured so as to restrict the relative rotational phase and so as to cancel the restriction. Furthermore, in a case where the restriction member 5 and the accommodation portion 34 are formed so as not to have the cylindrical shapes, the restriction member 5 and the accommodation portion 34 do not necessarily include the above-mentioned rotation restriction function. However, the restriction member 5 may be smoothly inserted/retracted into/from the restriction recessed portion 25 if the restriction member 5 and the accommodation portion 24 are formed in the cylindrical shapes.

Protruding portions may be provided at the inner rotor 3 so as to protrude towards the outer rotor 2 instead of the vanes 32 so that each of the fluid pressure chambers 4 is divided into the advanced angle chamber 41 and the retarded angle chamber 42 and so that the restriction member 5 and the accommodation portion 34 are provided at at least one of the protruding portions. In this case, each passage is easily formed at the valve timing control device 1.

In the first embodiment, the clearance 38 serves as the first clearance and the second clearance, however, the present invention is not limited to this configuration. For example, in a case where the clearance 38 does not serve as the first and second clearances, a third stepped portion may be formed at the restriction member 5 in order to separate the first clearance and the second clearance. Furthermore, as long as the first retaining passage 36 and the second retaining passage 37 are configured so as not to be in communication with each other when the restriction member 5 is retracted from the restriction recessed portion 25, the restriction member 5 does not need to be configured so as to include plural stepped portions so that the first retaining passage 36 is connected to a different clearance from a clearance to which the second retaining passage 37 is connected.

Second Embodiment

A second embodiment of a valve timing control device, which is adapted to the engine for the vehicle as a valve timing control device for an air intake valve will be described below in accordance with FIGS. 8 to 15 of the attached drawings. Illustrated in FIG. 9B is an expanded cross sectional diagram taken along line IXB-IXB in FIG. 9A. Each of FIGS. 10B, 11B, 12B, 13B and 14B is an expanded cross sectional diagram of each of FIGS. 10A, 11A, 12A, 13A and 14A taken along the same line as IBX-IXB in FIG. 9A.

<Entire Configuration>

Figure 8:
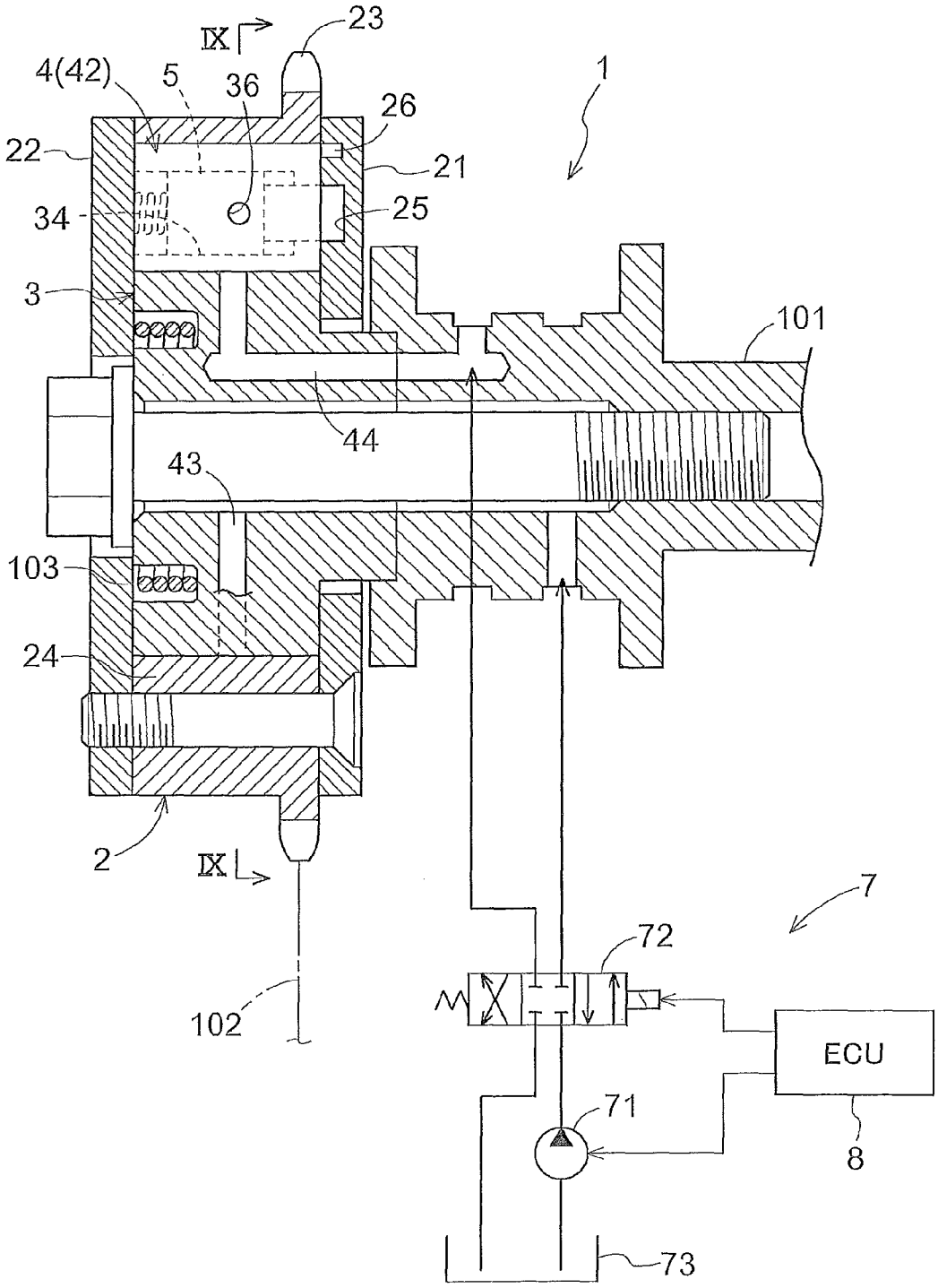
FIG. 8 is a cross sectional side view schematically illustrating a configuration example of an entire valve timing control device according to a second embodiment.
Figure 9A:
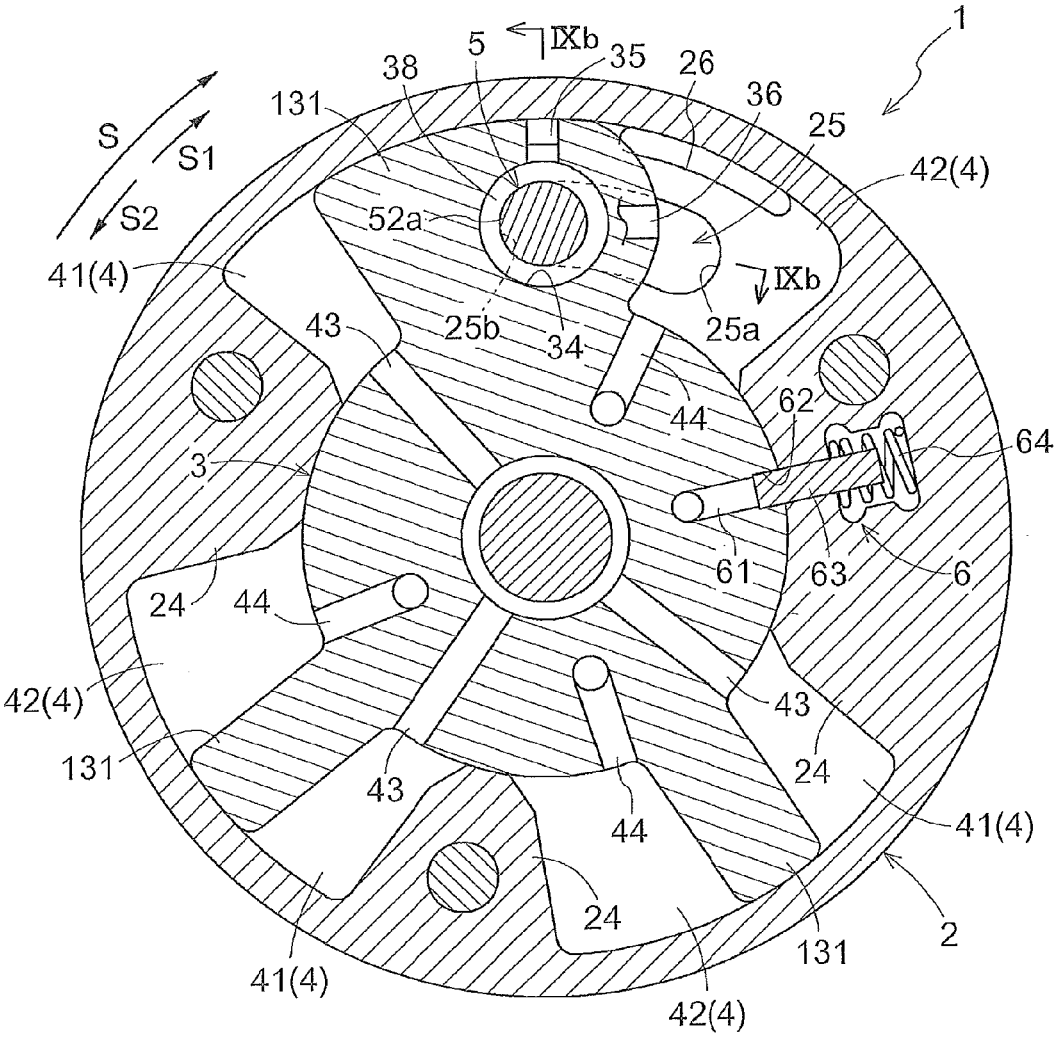
FIG. 9A is a cross sectional view taken along line IX-IX in FIG. 8 in a case where a relative rotational phase is retained at an intermediate lock phase.
Figure 9B:
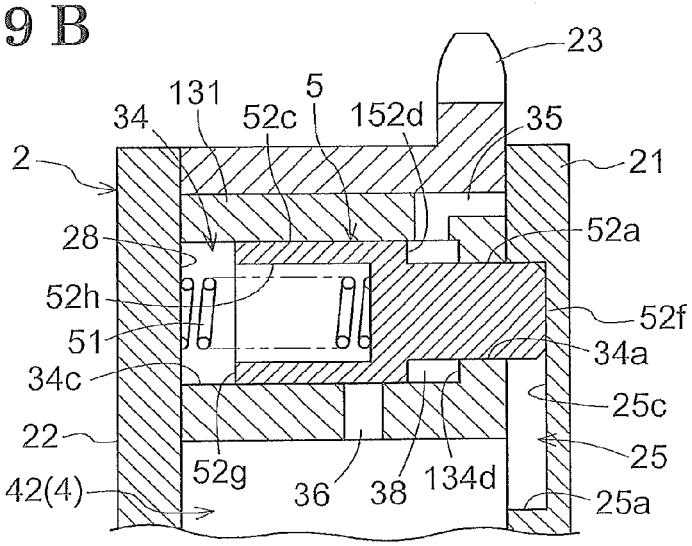
FIG. 9B is an expanded cross sectional side view illustrating state of a restriction member and the like taken along line IXB-IXB in FIG. 9A.
Figure 10A:
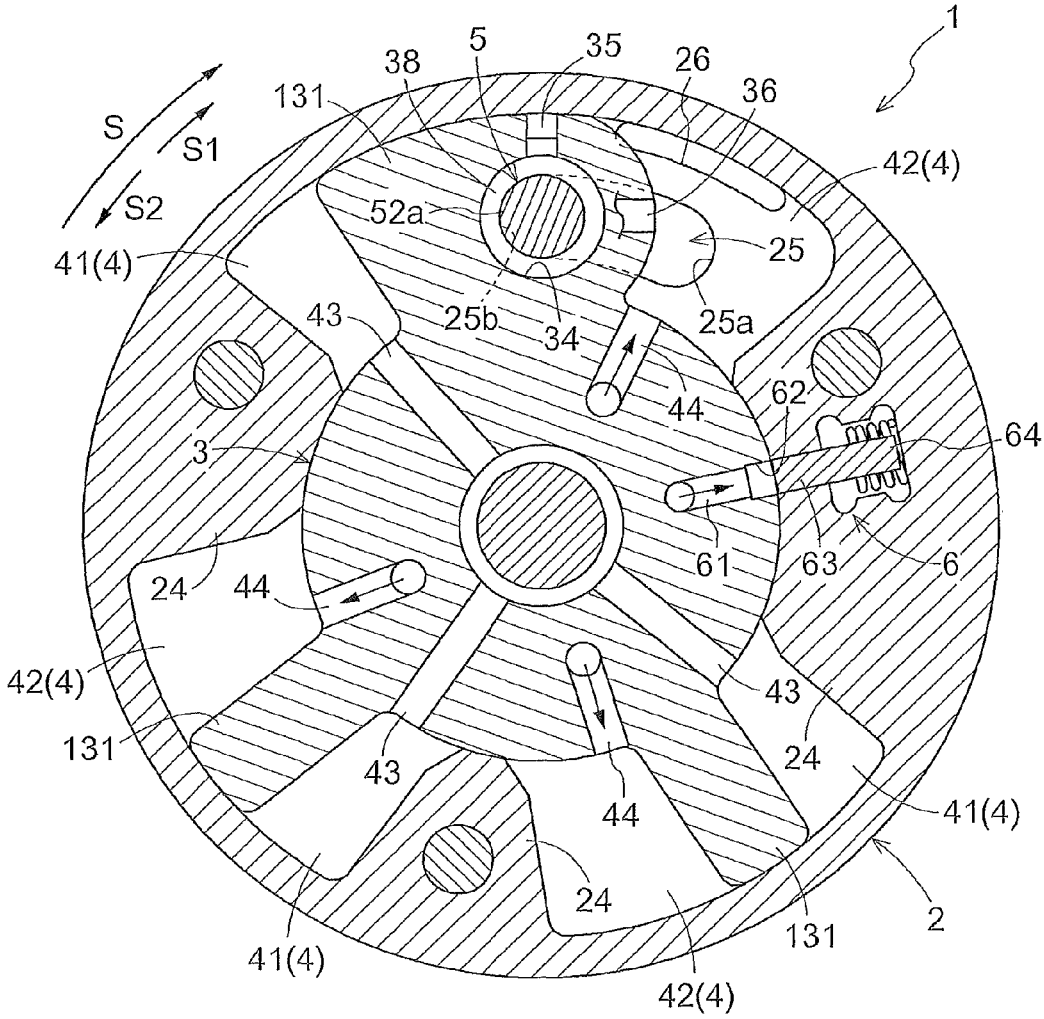
FIG. 10A is a cross sectional view taken along line IX-IX in FIG. 8 in the case where the relative rotational phase is retained at the intermediate lock phase.
Figure 10B:
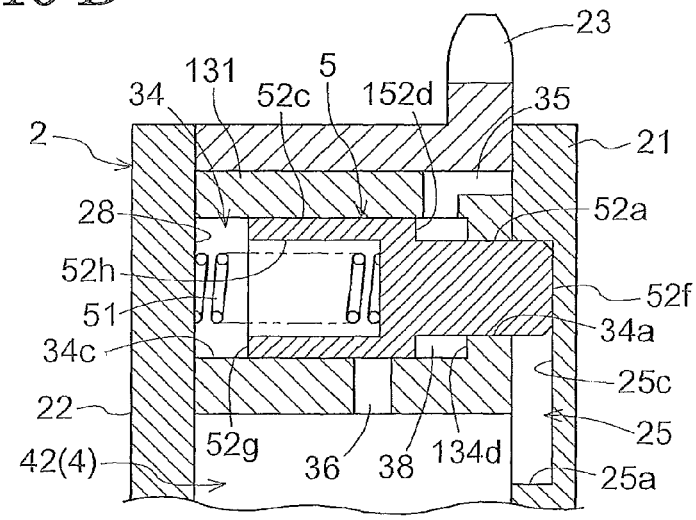
FIG. 10B is an expanded cross sectional side view illustrating the state of the restriction member and the like in the case where the relative rotational phase is retained at the intermediate lock phase.

As illustrated in FIG. 8, a valve timing control device 1 according to the second embodiment includes an outer rotor 2, which serves as the driving side rotational member, and an inner rotor 3, which serves as the driven side rotational member. The outer rotor 2 is synchronously rotatable relative to a crankshaft of an engine (an internal combustion engine). The inner rotor 3 is arranged coaxially with the outer rotor 2 and synchronously rotatable with a camshaft 101. The camshaft 101 is the rotational shaft of a cam, which controls opening and closing operations of the air intake valves of the engine.

When the crankshaft of the engine is driven to rotate, the outer rotor 2 is driven to rotate and the inner rotor 3 rotates in a relative rotational direction S indicated in FIG. 9 in response to the rotation of the outer rotor 2, thereby rotating the camshaft 101. As a result, the cam provided at the camshaft 101 presses down the air intake valves in order to open the air intake valves.

As illustrated in FIG. 9, plural protruding portions 24, each of which inwardly extends in the radial direction of the outer rotor 2, are arranged along the relative rotational direction S, while keeping a distance from each other in the relative rotational direction S. A fluid pressure chamber 4 is defined by the inner rotor 3 and each of the protruding portions 24. According to the second embodiment, as illustrated in FIG. 9, three fluid pressure chambers 4 are formed.

As illustrated in FIG. 9, protruding portions 131 are provided at an outer circumferential surface of the inner rotor 3 at portions thereof corresponding to the respective fluid pressure chambers 4 so as to outwardly protrude in the radial direction of the inner rotor 3. Each of the protruding portions 131 serves as a parting portion. Further, each of the fluid pressure chambers 4 is divided into an advanced angle chamber 41 and a retarded angle chamber 42 along the relative rotational direction S by means of each of the protruding portions 131.

An operation oil is supplied/discharged to/from either to the advanced angle chambers 41 or to the retarded angle chambers 42 by an operation fluid supply and discharge mechanism 7, so that the oil pressure of the operation oil acts on the protruding portions 131. Accordingly, the relative rotational phase of the inner rotor 3 relative to the outer rotor 2 is displaced in an advanced angle direction S1 or in a retarded angle direction S2 in FIG. 2. Alternatively, the relative rotational phase between the outer rotor 2 and the inner rotor 3 is retained at a predetermined phase.

A range within which the outer rotor 2 and the inner rotor 3 are rotatably movable relative to each other, i.e. a phase difference between a most advanced angle phase and a most retarded angle phase, is set so as to correspond to a range within which each of the protruding portions 131 is displaceable within each of the fluid pressure chambers 4.

A restriction member 5, a restriction recessed portion 25 and the like, which restrict the relative rotational phase to be displaceable in a range between the most advanced angle phase and a predetermined phase (which will be hereinafter referred to as the restriction range), according to the second embodiment will be described below in detail. Additionally, the predetermined phase (the predetermined angle phase) is set as a phase between the most advanced angle phase and the most retarded angle phase.

<Accommodation Portion>

Figure 15:
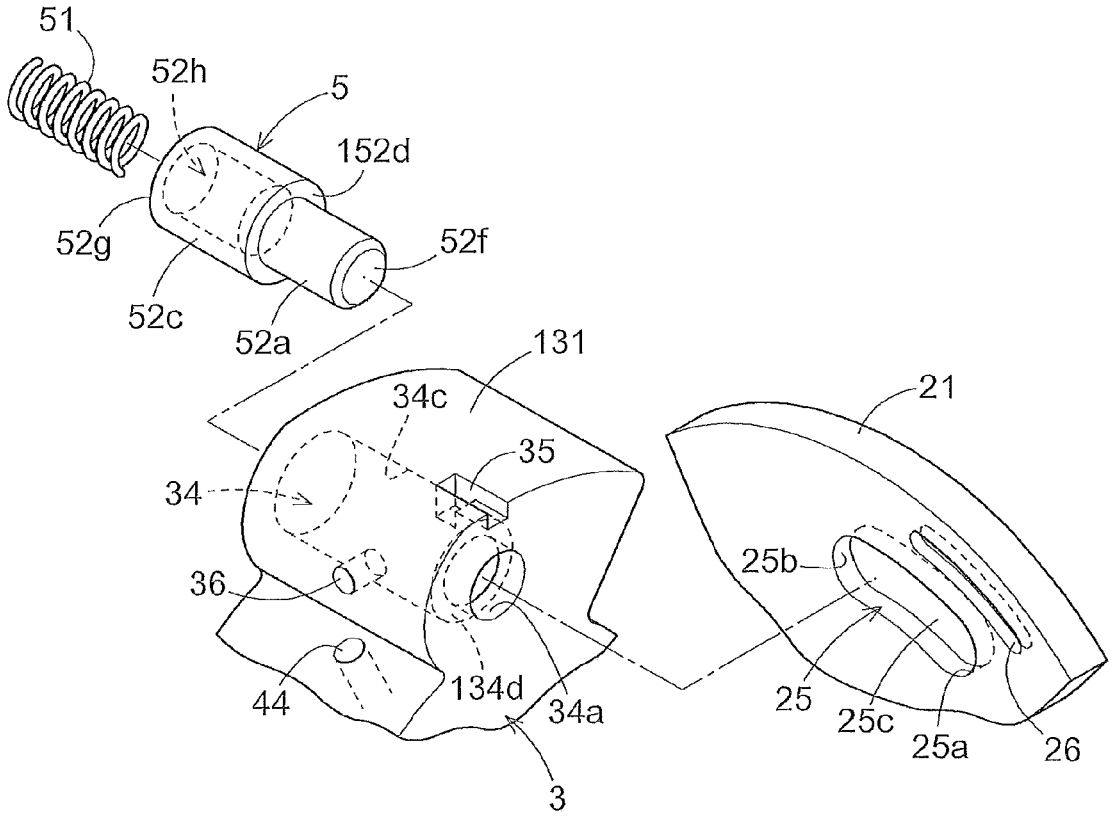
FIG. 15 is an exploded perspective view schematically illustrating a configuration example of each of the restriction member, an inner rotor and a rear plate.

As illustrated in FIGS. 9 and 15, an accommodation portion 34 is a bore, which is formed at one of the protruding portions 131 so as to extend along a rotational axis. Furthermore, the accommodation portion 34 is formed so as to penetrate the inner rotor 3 from one surface thereof facing a front plate 22 to the other surface facing a rear plate 21 (see FIG. 8). The accommodation portion 34 has a shape formed by piling two cylindrical bores (i.e. first and second cylindrical bores), which have different diameters from each other. Furthermore, the accommodation portion 34 is formed to have a slightly larger shape than a shape of the restriction member 5, so that the restriction member 5 is slidable within the accommodation portion 34. The accommodation portion 34 includes a first inner circumferential portion 34*a* defining the first cylindrical bore, a second inner circumferential portion 34*c* defining the second cylindrical bore having a larger diameter than the first inner circumferential portion 34*a* and a stepped portion 134*d*.

<Restriction Member>

As illustrated in FIGS. 9 and 15, the restriction portion 5 has a shape formed by piling two cylindrical portions (i.e. first and second cylindrical portions) having different diameters from each other. A recessed portion 52*h* in a cylindrical shape is formed inside the restriction member 5. The diameter of the first cylindrical portion of the restriction portion 5 facing the rear plate 21 is set to be smaller than the diameter of the second cylindrical portion of the restriction portion 5 facing the front plate 22. The restriction portion 5 includes a first outer circumferential portion 52*a* defining the first cylindrical portion, a second outer circumferential portion 52*c* defining the second cylindrical portion, a stepped portion 152*d*, an end portion 52*f* and a base portion 52*g*. As described above, shapes of the first inner circumferential portion 34*a*, the second inner circumferential portion 34*c* and the stepped portion 134*d* of the accommodation portion 34 are determined so as to correspond to the first outer circumferential portion 52*a*, the second outer circumferential portion 52*c* and the stepped portion 152*d* of the restriction member 5, respectively.

<Restriction Recessed Portion>

As illustrated in FIGS. 9 and 15, the restriction recessed portion 25 is an elongated groove, which is formed on a surface of the rear plate 21 facing the inner rotor 3. More specifically, the restriction recessed portion 25 is formed in an arc shape having the rotational axis as a center point. The restriction recessed portion 25 is configured with a first end portion 25*a*, a second end portion 25*b*, a bottom portion 25*c* and side portions extending along a longitudinal direction of the restriction recessed portion 25. As illustrated in FIGS. 9, 13 and 14, the restriction recessed portion 25 may be opened to one of the retarded angle chambers 42 in response to the displacement of the relative rotational phase. In this embodiment, the restriction recessed portion 25 is configured so as to be opened to one of the retarded angle chambers 42 because of an arrangement of each component of the valve timing control device 1. However, the present invention is not limited to this configuration of the restriction recessed portion 25. More specifically, the restriction recessed portion 25 does not always need to be opened to one of the retarded angle chambers 42.

<Relationship Among Accommodation Portion, Restriction Member and Restriction Recessed Portion>

Figure 11A:
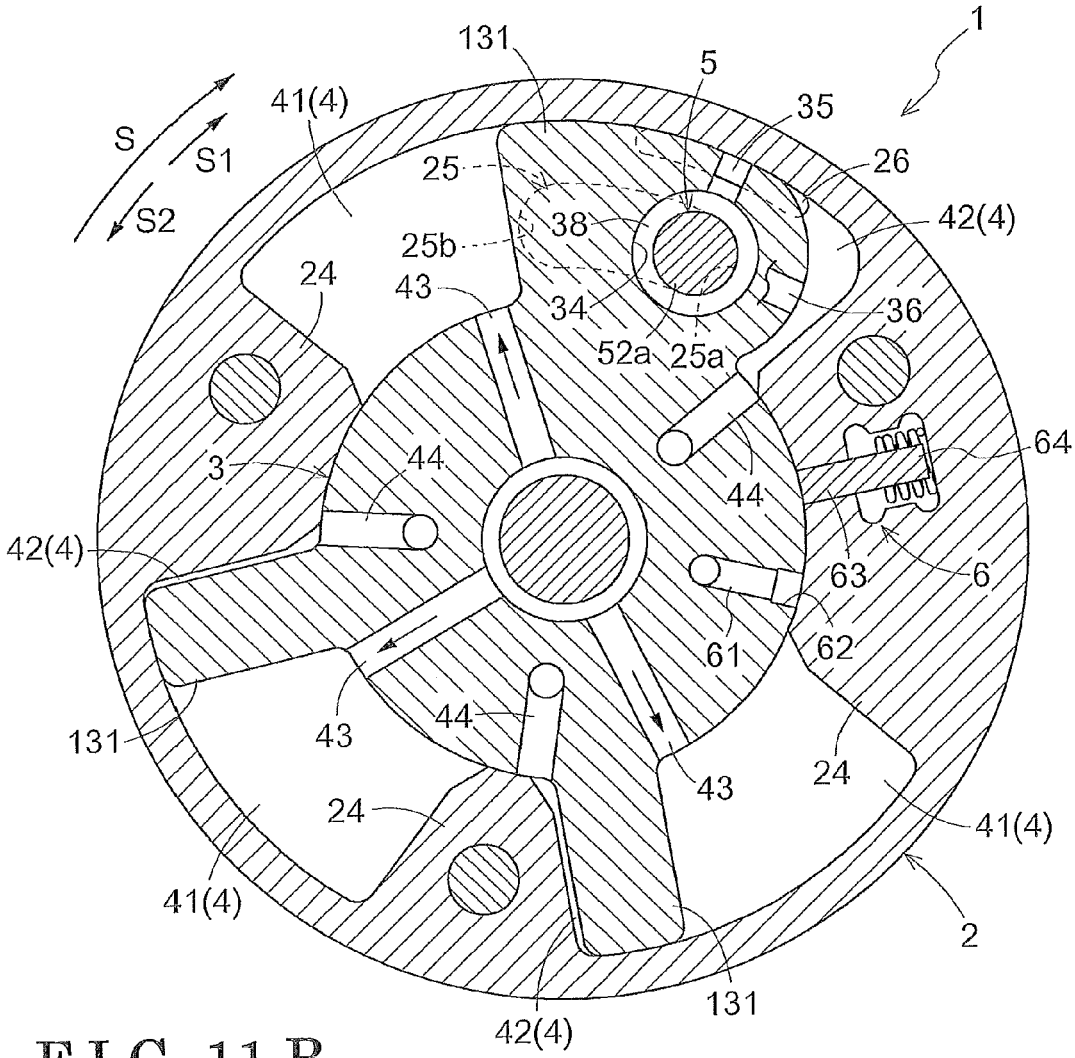
FIG. 11A is a cross sectional view taken along line IX-IXI in FIG. 8 in a case where the relative rotational phase is retained at a most advanced angle phase.
Figure 11B:
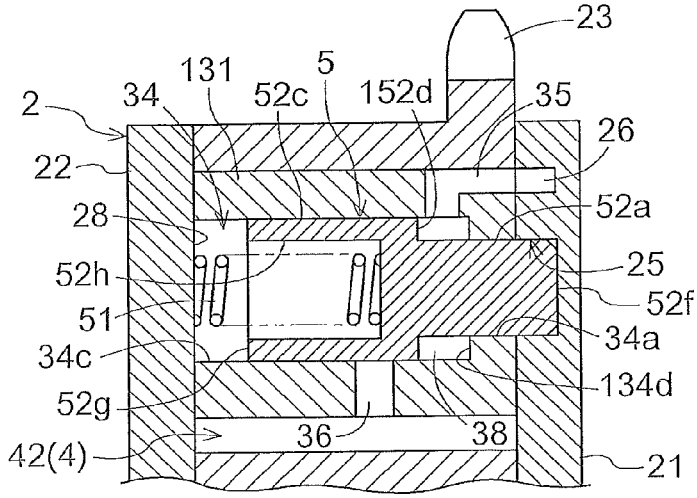
FIG. 11B is an expanded cross sectional side view illustrating the state of the restriction member and the like in the case where the relative rotational phase is retained at the most advanced angle phase.
Figure 12A:
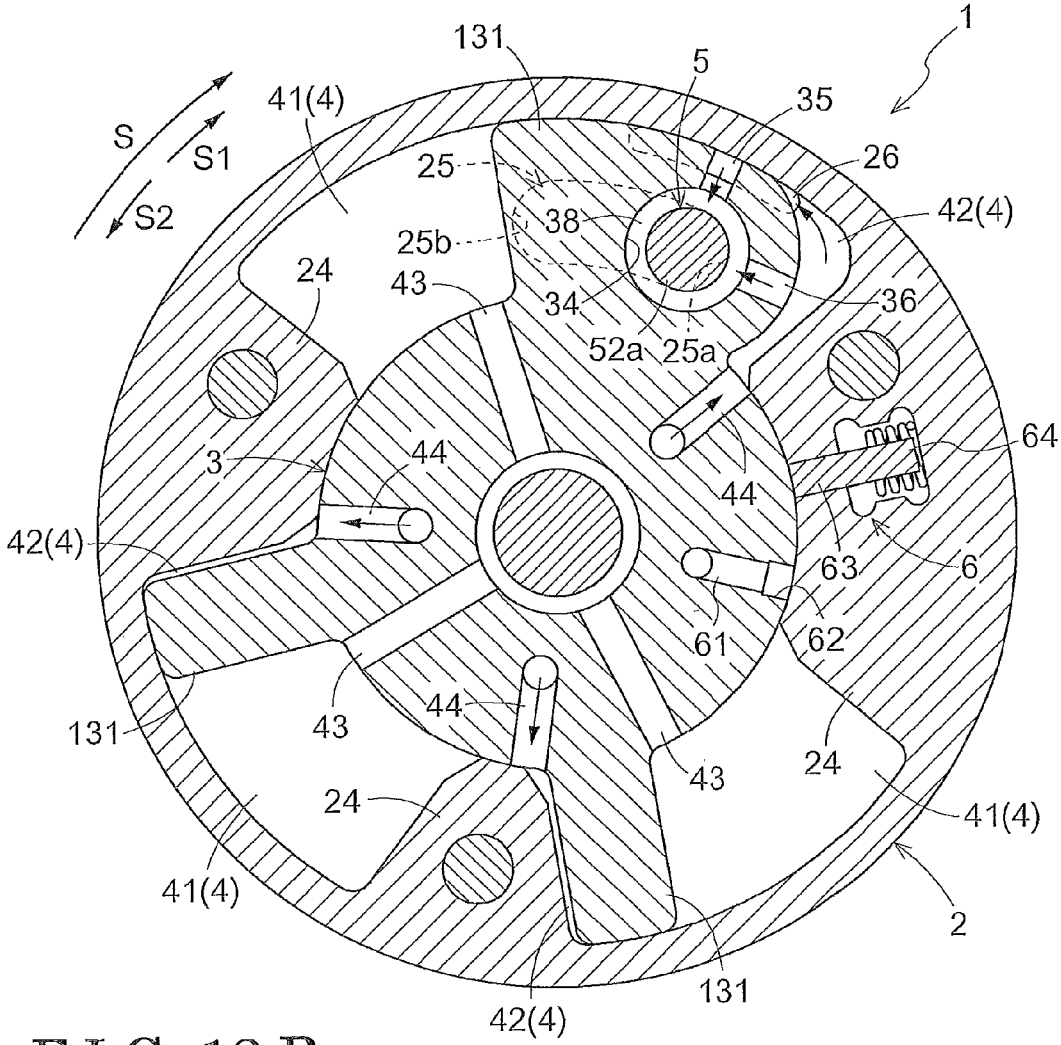
FIG. 12A is a cross sectional view taken along line IX-IX in FIG. 8 in the case where the relative rotational phase is retained at the most advanced angle phase.
Figure 12B:
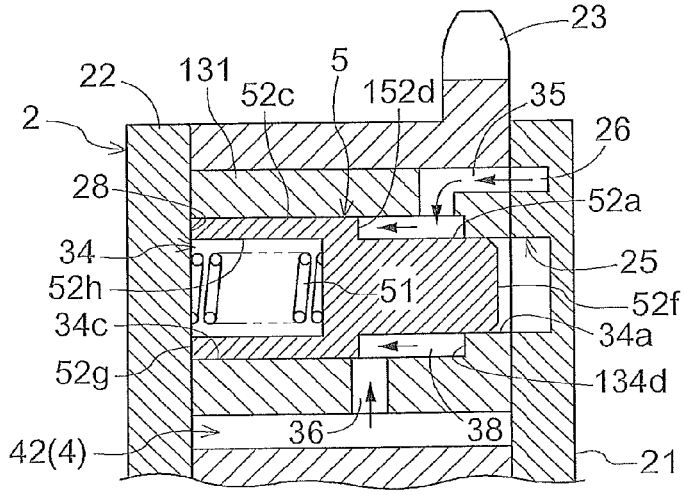
FIG. 12B is an expanded cross sectional side view illustrating the state of the restriction member and the like in the case where the relative rotational phase is retained at the most advanced angle phase.
Figure 13A:
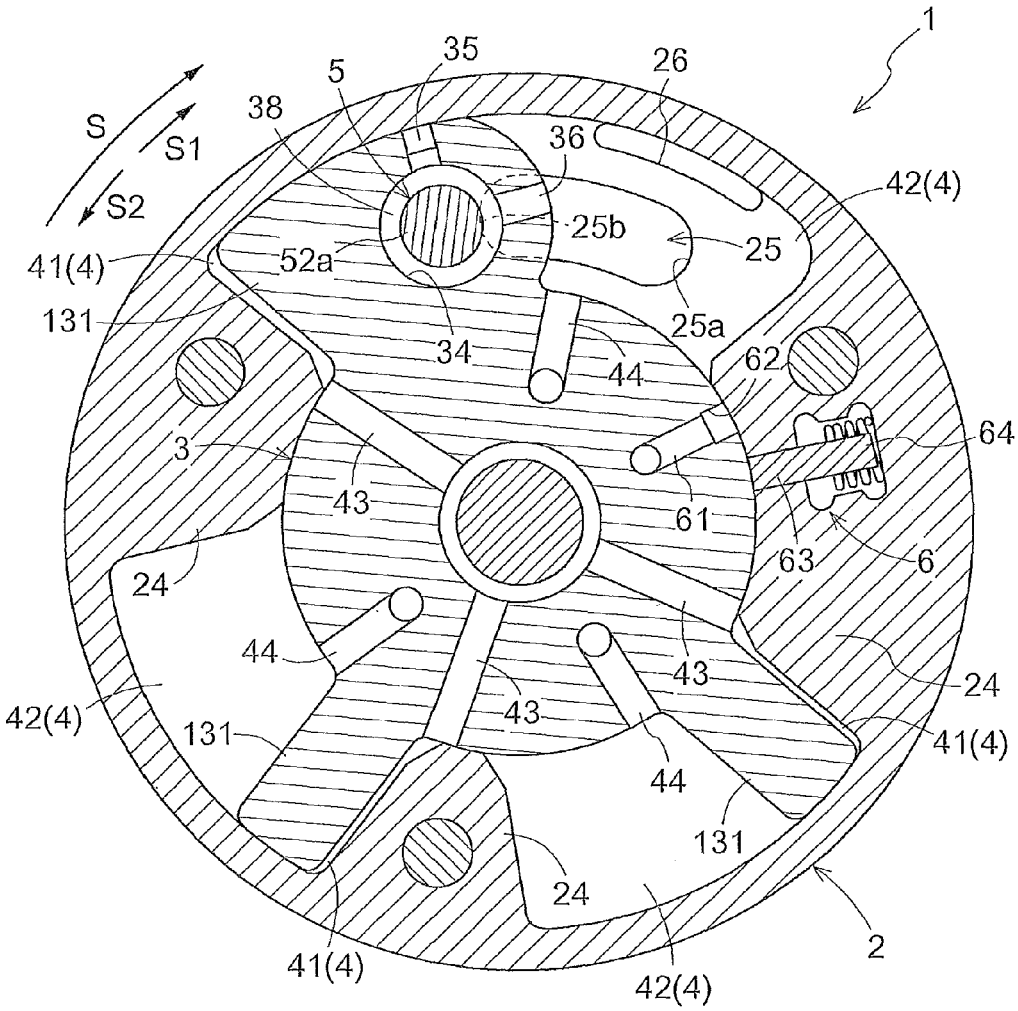
FIG. 13A is a cross sectional view taken along line IX-IX in FIG. 8 in a case where the relative rotational phase is retained at a most retarded angle phase.
Figure 13B:
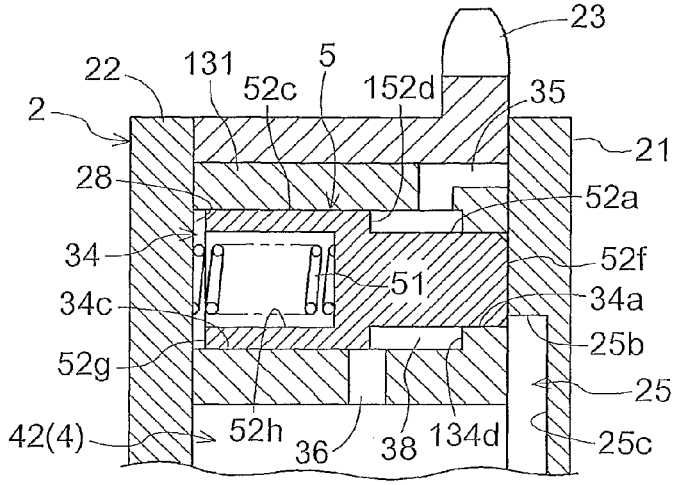
FIG. 13B is an expanded cross sectional side view illustrating the state of the restriction member and the like in the case where the relative rotational phase is retained at the most retarded angle phase.
Figure 14A:
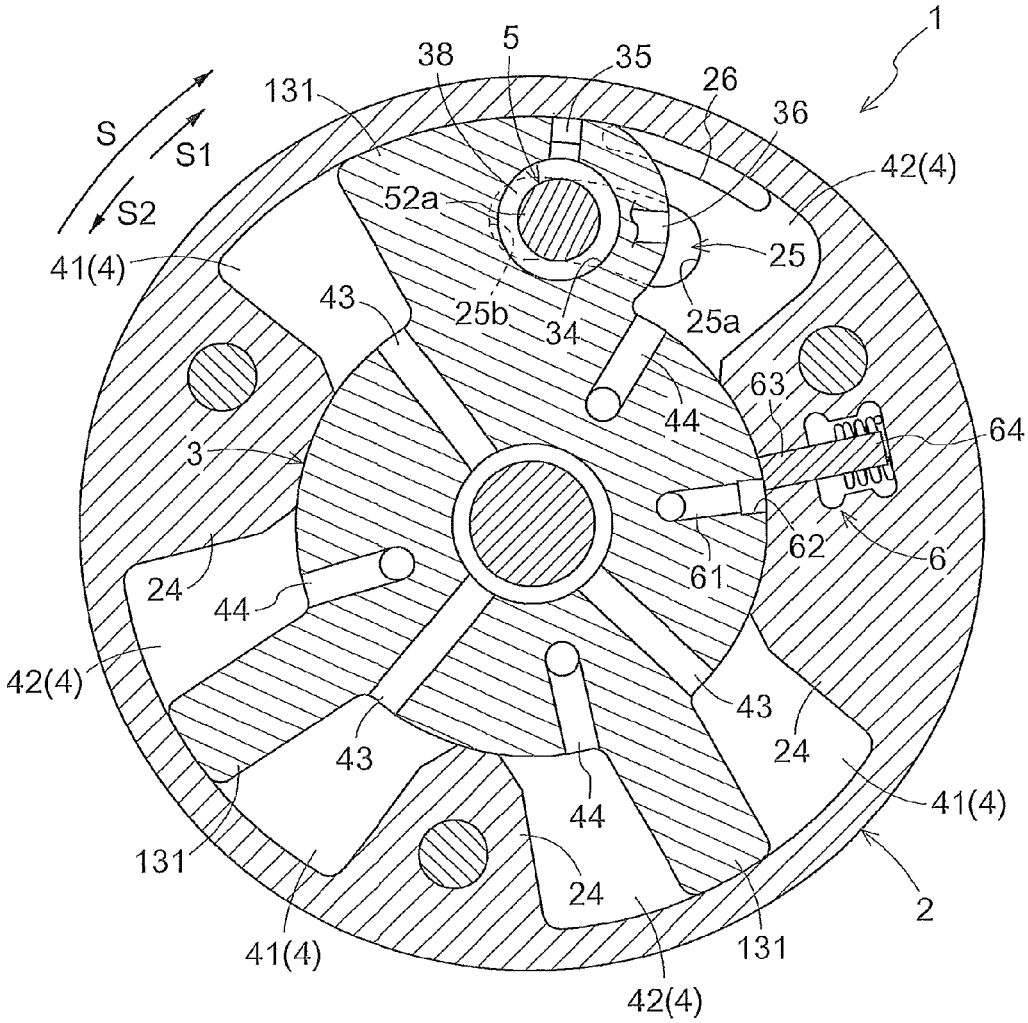
FIG. 14A is a cross sectional view taken along line IX-IX in FIG. 8 in a case where the relative rotational phase is displaced at a phase, which is positioned at an advanced angle phase side relative to the intermediate lock phase and which is the phase to be displaced in a case where a first passage and a second passage do not communicate with each other.
Figure 14B:
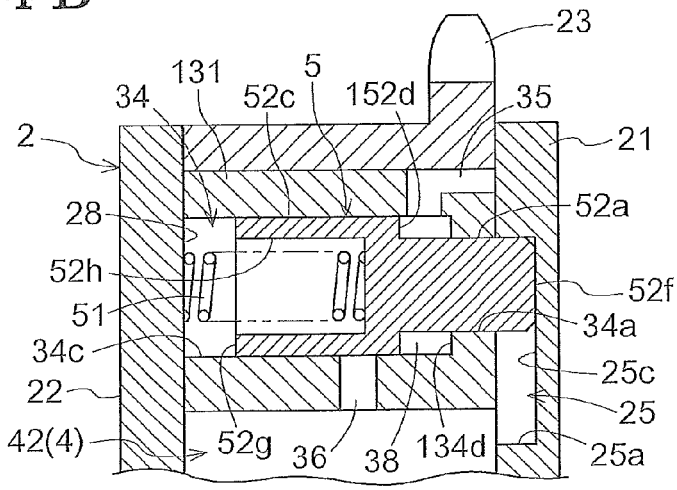

As illustrated in FIG. 9, the restriction recessed portion 25 is formed so that a phase, which is established when the first outer circumferential portion 52*a* of the restriction member 5 contacts the second end portion 25*b* of the restriction recessed portion 25, corresponds to the predetermined phase between the most advanced angle phase and the most retarded angle phase while a restricted state is established. Hereinafter, the predetermined phase, which is set between the most advanced angle phase and the most retarded angle phase, will be referred to as an intermediate lock phase. The intermediate lock phase refers to a phase, at which the engine may be started. Furthermore, as illustrated in FIG. 11A, the restriction recessed portion 25 is formed so that a phase, which is established when the first outer circumferential portion 52*a* of the restriction member 5 contacts the first end portion 25*a* of the restriction recessed portion 25, corresponds to the most advanced angle phase. In other words, when the restriction member 5 is inserted into the restriction recessed portion 25, the displacement of the relative rotational phase is restricted within the range between the most advanced angle phase and the intermediate lock phase.

As illustrated in FIG. 9, the restriction member 5 and the accommodation portion 34 are formed so that a slight clearance 38 is formed between the stepped portion 152*d* of the restriction member 5 and the stepped portion 134*d* of the accommodation portion 34 when the restriction recessed portion 5 is inserted into the restriction recessed portion 25. The clearance 38, which is defined by the first outer circumferential portion 52*a* and the stepped portion 152*d* of the restriction member 5 (see FIG. 15) and the second inner circumferential portion 34*c* and the stepped portion 134*d* of the accommodation portion 34 and which is formed in a circular shape, is referred to also as a "clearance between the accommodation portion 34 and the stepped portion 152*d*" and a "clearance formed between the accommodation portion 34 and the restriction member 5".

In the second embodiment, the restriction recessed portion 25 is opened to one of the retarded angle chambers 42 at a certain timing. If a clearance is formed between the end portion 52*f* of the restriction member 5 and the bottom portion 25*c* of the restriction recessed portion 25, the restriction member 5 may unexpectedly be retracted from the restriction recessed portion 25 by the retarded angle control even if a second passage 35 is not connected to a first passage 26. Hence, in the second embodiment, the restriction member 5 and the restriction recessed portion 25 are formed so as not to form the clearance between the end portion 52*f* of the restriction member 5 and the bottom portion 25*c* of the restriction recessed portion 25 in the case where the restriction member 5 is inserted into the restriction recessed portion 25, as illustrated in FIG. 9B.

<First Passage and Second Passage>

As illustrated in FIGS. 9 and 15, the first passage 26 is formed on the surface of the rear plate 21 facing the inner rotor 3. As is the case with the restriction recessed portion 25, the first passage 26 is an elongated groove, which is formed in an arch shape having the rotational axis as a center point. The first passage 26 is configured so that one end portion thereof is communicatable with one of the retarded angle chambers 42 in response to the rotational movement of the inner rotor 3 relative to the outer rotor 2. Furthermore, the first passage 26 is configured so that the one end portion thereof communicates with one of the retarded angle chambers 42 at least while the restricted state is being established. The other end portion of the first passage 26 is not in communication with the restriction recessed portion 25.

As illustrated in FIGS. 9 and 15, the second passage 35 is defined by a groove, which is formed on an outer circumferential surface of one of the protruding portions 131 at which the accommodation portion 34 is formed, and an inner circumferential surface of the outer rotor 2 at a portion thereof corresponding to the groove formed on the outer circumferential surface of one of the protruding portions 131. The second passage 35 extends along the rotational axis from a surface of the inner rotor 3 facing the rear plate 21, and is inwardly bent in the radial direction so as to form substantially L-shape when being viewed from a direction orthogonal to the axial direction of the valve timing control device 1 (see e.g. FIG. 9), so that an end portion of the second passage 35 opens to the clearance 38. The other end portion of the second passage 35 opens to the rear plate 21.

As illustrated in FIG. 11, when the second passage 35 is connected to the first passage 26 while the restricted state is established, the clearance 38 communicates with one of the retarded angle chambers 42. Accordingly, when the retarded angle control is executed in the case where the clearance 38 is being in communication with one of the retarded angle chambers 42 while the restricted state is established, the operation oil is supplied also to the clearance 38 via the first passage 26 and the second passage 35. Therefore, an oil pressure of the operation oil acts on the stepped portion 152*d* of the restriction member 5 so as to press the stepped portion 152*d* in a retracting direction. As a result, the restriction member 5 is slid along the accommodation portion 34 and is retracted from the restriction recessed portion 25, thereby establishing an unrestricted state, as illustrated in FIG. 12.

A length of the first passage 26 is determined so as not to be connected to the second passage 35 at least in the case where the first outer circumferential portion 52*a* of the restriction member 5 approaches the second end portion 25*b* of the restriction recessed portion 25 (i.e. at least in a case where the relative rotational phase is displaced so as to substantially form the intermediate lock phase), as illustrated in FIG. 9. A range within which the second passage 35 is not connected to the first passage 26, i.e. an extended position of an end portion of the first passage 26 positioned in the vicinity of the intermediate lock phase may be determined at any desired position as long as the extended position of the end portion of the first passage 26 is positioned between a position at which the intermediate lock phase is established and a position at which the most advanced phase is established.

<Retaining Passage>

As illustrated in FIGS. 9 and 15, a retaining passage 36 is formed at one of the protruding portions 131, at which the accommodation portion 34 is formed. The retaining passage 36 connects one of the retarded angle chambers 42 and the second inner circumferential portion 34*c* of the accommodation portion 34 in order to establish a communication therebetween.

As illustrated in FIG. 9, one end portion of the retaining passage 36, which connected to the accommodation portion 34, is closed by the second outer circumferential portion 52*c* of the restriction member 5 when the restriction member 5 is inserted into the restriction recessed portion 25. On the other hand, as illustrated in FIG. 12, when the restriction member 5 is retracted from the restriction recessed portion 25, the one end portion of the retaining passage 36, which is connected to the accommodation portion 34, is opened to the clearance 38. In other words, when the restriction member 5 is retracted from the restriction recessed portion 25 by the operation oil, which is supplied to the first and second passages 26 and 35 from one of the retarded angle chambers 42, the retaining passage 36 connects one of the retarded angle chambers 42 with the clearance 38 in order to establish the communication therebetween.

Once the unrestricted state is established, the operation oil is kept being supplied to the clearance 38 as long as the retarded angle control is being executed (continued). The stepped portion 152*d* of the restriction member 5 is pressed in the retracting direction by the oil pressure of the operation oil, thereby maintaining the restriction member 5 to be retracted from the restriction recessed portion 25 (i.e. thereby maintaining a retracted state of the restriction member 5). Therefore, as illustrated in FIG. 13, even if the relative rotational phase is displaced towards the retarded angle phase after the restriction member 5 is retracted from the restriction recessed portion 25 and where the second passage 35 is misaligned (offset) relative to the first passage 26, the unrestricted state is maintained. As a result, the restriction member 5 is operated in order to displace the relative rotational phase towards the retarded angle phase so as to move over the second end portion 25*b* of the restriction recessed portion 25.

Then, when the EUC 8 switches to the advanced angle control from the retarded angle control, the oil pressure stops acting on the stepped portion 152*d* of the restriction member 5, therefore, the restriction member 5 is to be inserted into the restriction recessed portion 25. However, while the relative rotational phase is retained within a range of the most retarded angle phase relative to the intermediate lock phase, the end portion 52*f* of the restriction member 5 only contacts the inner surface of the rear plate 21 facing the inner rotor 3, and the end portion 52*f* of the restriction member 5 is not inserted into the restriction recessed portion 25 formed on the inner surface of the rear plate 21. When the relative rotational phase is displaced within a range of the most advanced angle phase relative to the intermediate lock phase, the restriction member 5 is inserted into the restriction recessed portion 25, thereby establishing the restricted state. In order to displace the relative rotational phase again within the retarded angle phase relative to the intermediate lock phase, the ECU 8 executes the advanced angle control until the relative rotational phase is displaced to a phase by which the second passage 35 is connected to the first passage 26, and then, the ECU 8 switches to the retarded angle control.

<Leak Passage>

The valve timing control device 1 may be modified so as to include a leak passage, as described in the first embodiment.

<Lock Mechanism>

As illustrated in FIG. 9, the valve timing control device 1 includes a lock mechanism 6 for locking the relative rotational phase at the intermediate lock phase. The lock mechanism 6 includes a lock passage 61, a lock groove 62 and a lock member 63. The lock member 63 is configured so as to be insertable/retractable into/from the lock groove 62. However, even if the lock member 6 is retracted from the lock groove 62, the restricted state is maintained while the restriction member 5 is being inserted into the restriction recessed portion 25, therefore, the relative rotational phase is restricted within the above-described restriction range.

The lock passage 61 is diverged from the retarded angle passages 44, so that the operation oil is supplied to the lock passage 61 when the operation oil is supplied to the retarded angle passages 44. More specifically, as illustrated in FIG. 8, a groove is formed on the camshaft 101 in a circular shape so as to connect the retarded angle passages 44. The lock passage 61 is also formed so as to be connected to the circular shaped groove. In other words, the lock passage 61 is diverged from the circular shaped groove, which also connects the retarded angle passages 44. The lock member 63 is pressed in a retracting direction by the oil pressure of the operation oil. Then, when the oil pressure of the operation oil acting on the lock member 63 exceeds a biasing force generated by a spring 64, the lock member 63 is retracted from the lock groove 62 (i.e. a retracted state). Once the lock member 63 is retracted from the lock groove 62, the lock member 63 is maintained at the retracted state by a centrifugal force generated when the outer rotor 2 and the inner rotor 3 rotate relative to each other. When the rotational number (i.e. the rotational speed) of the engine decreases and when the centrifugal force becomes smaller than the biasing force generated by the spring 64, the lock member 63 is again biased in an inserting direction (i.e. a direction by which the lock member 63 is inserted into the lock groove 62) by the spring 64. Accordingly, when the relative rotational phase is displaced at the intermediate lock phase, the lock member 63 is inserted into the lock groove 62. On the other hand, in the case where the relative rotational phase is not retained at the intermediate lock phase, an inner end portion of the lock member 62 in the radial direction only contacts the outer circumferential surface of the inner rotor 3, and the relative rotational phase is not locked.

<Operation Fluid Supply and Discharge Mechanism>

According to the second embodiment, when a power supply is turned on, a flow switching valve 72 is displaced to the left in FIG. 9, thereby establishing an operation oil passage, by which the retarded angle control is executable. On the other hand, in a case where the power supply is turned off, the flow switching valve 72 is displaced to the right in FIG. 9, thereby establishing an operation oil passage by which the advanced angle control is executable.

Further, in the second embodiment, the power supply to the flow switching valve 72 may be controlled by changing a duty ratio in order to control the supply of the operation oil to the advanced angle chambers 41 and the retarded angle chambers 42 and the discharge of the operation oil from the advanced angle chambers 41 and the retarded angle chambers 42.

<Operation of Valve Timing Control Device>

An operation example of the valve timing control device 1 in a case where the engine is started while the relative rotational phase is retained at the intermediate lock phase will be described below.

When the engine is stopped (i.e. an engine stopped state), a pump 71 is not driven (i.e. the pump 71 is stopped). The power supply to the flow switching valve 72 is turned off while the engine is stopped. Accordingly, the operation passage, by which the advanced angle control is executable, is established. As illustrated in FIG. 9, in this case, the lock member 63 is inserted into the lock groove 62, so that the relative rotational phase is locked at the intermediate lock phase. Further, in this case, the restriction member 5 is inserted into the restriction recessed portion 25 and the restricted state is established.

Once a starting control of the engine is started, a cranking occurs. The pump 71 is actuated by the cranking. However, the power supply to the flow switching valve 72 remains to be turned off. Furthermore, the operation oil passage by which the advanced angle phase control is executable is still being established. Therefore, the operation oil is not supplied to the lock passage 61. Accordingly, the locking state of the relative rotational phase by the lock mechanism 6 is maintained. Hence, the engine is appropriately started while the relative rotational phase is retained at the lock phase.

Then, the ECU 8 executes the retarded angle control, so that the operation oil is supplied to the retarded angle passages 44 and the lock passage 61 from the operation fluid supply and discharge mechanism 7. As illustrated in FIG. 10, once the oil pressure of the operation oil reaches a predetermined oil pressure, the lock member 63 is retracted from the lock groove 62, thereby canceling the locking of the relative rotational phase by the lock mechanism 6. As a result, the relative rotational phase becomes displaceable within the restriction range.

In a case where the relative rotational phase is displaced towards the retarded angle phase relative to the intermediate lock phase afterwards, the restricted state of the restriction member 5 needs to be cancelled and the unrestricted state needs to be established. Therefore, the ECU 8 executes the advanced angle control, and then, when the relative rotational phase is displaced to the phase, by which the first passage 26 and the second passage 35 are connected to each other as illustrated in FIG. 11, the ECU 8 switches to execute the retarded angle control from the advanced angle control. In this case, because the operation oil is supplied to the clearance 38, the restriction member 5 is retracted from the restriction recessed portion 25, thereby establishing the unrestricted state. When the restriction member 5 is retracted from the restriction recessed portion 25, the operation oil is also supplied to the clearance 38 from the retaining passage 36, therefore, the retracted state of the restriction member 5 is surely maintained. As a result, as illustrated in FIG. 13, the restriction member 5 becomes movable to a position, at which the retarded angle phase is established, so as to move over the second end portion 25*b* of the restriction recessed portion 25.

In a case where the advanced angle control is being executed while the engine is normally driven, the operation oil is not supplied to the first passage 26 and the retaining passage 36, and the restriction member 5 is turned to be in the restricted state by the restriction member 5 being inserted into the restriction recessed portion 25 when the relative rotational phase is displaced so as to exceed the intermediate lock phase from the most retarded angle phase. However, even in this case, the relative rotational phase is displaceable within the restriction range. Additionally, even in a case where the relative rotational phase is displaced towards the retarded angle phase relative to the intermediate lock phase, the relative rotational phase is freely displaceable within the range between the intermediate lock phase and the most retarded angle phase. In other words, the relative rotational phase is displaceable to an appropriate phase within the range between the most advanced angle phase and the most retarded angle phase in response to the number of rotations (i.e. the rotational speed) of the engine and the load applied to the engine.

The ECU 8 detects the number of rotations of the engine, the load applied to the engine, a position of the relative rotational phase and the like. The number of rotations of the engine and the load applied to the engine decrease just before the engine is stopped, therefore, the engine becomes an idling state (i.e. a state where the engine idles). Therefore, the ECU 8 detects the number of rotations of the engine and the like, so that the ECU 8 executes a control of the valve timing control device 1 when the engine becomes the idling state in order to retain the relative rotational phase at the intermediate lock phase in preparation for starting the engine again. The operation examples of the valve timing control device 1 depending on positions of the relative rotational phase before the engine turns to be in the idling state will be described.

In the case where the relative rotational phase is retained between the intermediate lock phase and the most retarded angle phase as illustrated in FIG. 13, firstly, the advanced angle control is executed. When the relative rotational phase is displaced so as to exceed the intermediate lock phase, the restriction member 5 is inserted into the restriction recessed portion 25, thereby establishing the restricted state. Secondly, the ECU 8 switches to execute the retarded angle control from the advanced angle control before the second passage 36 is displaced to reach the second end portion 25*b* of the first passage 25 positioned so as to correspond to the intermediate lock phase. The restriction member 5 is not likely to be retracted from the restriction recessed portion 25 and the restriction member 5 is pressed against the second end portion 25*b* of the restriction recessed portion 25 by a displacement force generated towards the retarded angle phase by the retarded angle control. The displacement force towards the retarded angle phase is generated when applying the operation oil to the retarded angle chambers 42 in order to displace the protruding portions 131 towards the advanced angle chambers 41 in order to form the retarded angle phase. Accordingly, the relative rotational phase is retained at the intermediate lock phase. When the engine is stopped and the number of rotations of the engine decreases under this condition, the lock member 63 is inserted into the lock groove 62. As a result, the relative rotational phase is surely locked at the intermediate lock phase. Even if the engine is not stopped, the relative rotational phase becomes freely displaceable by executing the advanced angle control or the retarded angle control because the relative rotational phase is not locked by the lock mechanism 6.

In a case where the relative rotational phase is retained between the intermediate lock phase and the most advanced angle phase, more specifically, in the case where the relative rotational phase is retained at the phase by which the second passage 36 is not connected to the first passage 25, as illustrated in FIG. 14, the retarded angle control is executed. The restriction member 5 is not retracted from the restriction recessed portion 25 and is pressed against the second end portion 25*b* of the restriction recessed portion 25 by the displacement force generated towards the retarded angle phase by the retarded angle control. Accordingly, the relative rotational phase is retained at the intermediate lock phase.

In a case where the relative rotational phase is retained between the intermediate lock phase and the most advanced angle phase, more specifically, in the case where the relative rotational phase is retained at a phase within a range between a phase by which the second passage 36 starts being connected to the first passage 25 and the most advanced angle phase, as illustrated in FIG. 11, the retarded angle control is executed so that the restriction member 5 moves over the second end portion 25*b* of the restriction recessed portion 25 once in order to displace the relative rotational phase towards the retarded angle phase relative to the intermediate lock phase. Then, as similar to the case where the relative rotational phase is retained between the intermediate lock phase and the most retarded angle phase, the ECU 8 executes the advanced control and then the retarded angle control.

Accordingly, the state of the restriction member 5 is properly controlled by switching the advanced angle control and the retarded angle control without providing a separate flow switching valve and the like for inserting/retracting the restriction member 5 into/from the restriction recessed portion 25. As a result, the relative rotational phase is locked at the intermediate lock phase in preparation for starting the engine again.

Accordingly, the engine may be started under a condition where the relative rotational phase is retained at the intermediate lock phase by which the engine is startable. Therefore, after the engine is started, the Atkinson cycle may be effectively utilized at the engine by displacing the relative rotational phase in the range between the intermediate lock phase and the most retarded angle phase. As a result, the fuel consumption of the engine, the output of the engine and the like may be improved. Additionally, the range of the retarded angle phase relative to the intermediate lock phase (i.e. the range between the intermediate lock phase and the most retarded angle phase) may also be referred to as "extremely retarded angle are".

The valve timing control device 1 according to the second embodiment may be adapted to the exhaust valves. In this case, the description "advanced angle" should be replaced with the "retarded angle", and similarly, the description "retarded angle" should be replaced with the "advanced angle".

Vanes may be provided at the inner rotor 3 instead of the protruding portions 131, so that each of the vanes divide each of the fluid pressure chambers 4 into the advanced angle chamber 41 and the retarded angle chamber 42. In this case, larger space may be ensured for the outer rotor 2 in the circumferential direction thereof. Therefore, for example, a displacement angle of the relative rotational angle when being displaced may be increased.

According to the above-described embodiments, the relative rotational phase is surely locked or restricted at a predetermined phase between the most advanced angle phase and the most retarded angle phase when the internal combustion engine is stopped or started. Furthermore, the valve timing control device 1 of the embodiments may be adapted so as to control opening/closing timing of the air intake valve(s) and/or the exhaust valve(s) of the engine of the vehicle and the like.

Accordingly, the communication between the first passage 26 and the second passage 35 on the one hand and one of the advanced angle chambers 41 or one of the retarded angle chambers 42 on the other hand, respectively, is interrupted at least when the restriction member 5 contacts either one of the first end portion 25*a* and the second end portion 25*b* of the restriction recessed portion 25. Accordingly, chances of the restriction recessed portion 5 being retracted from the restriction recessed portion 25 are reduced, and furthermore, chances of the restriction recessed portion 5 being displaced so as to move over the second end portion 25*b* of the restriction recessed portion 25 positioned so as to correspond to the predetermined phase are reduced. Therefore, the restriction member 5 may be pressed against the second end portion 25*b* of the restriction recessed portion 25 positioned so as to correspond to the predetermined phase by executing the retarded angle control or the advanced angle control afterwards. As a result, the relative rotational phase is surely locked or restricted at an appropriate predetermined phase. According to the valve timing control device 1 of the embodiments, the relative rotational phase is surely locked or restricted at the appropriate phase only by executing the retarded angle control or the advanced angle control with simple configuration and less components used at the valve timing control device 1.

According to the embodiments, the communication between the accommodation portion 34 and the one of the advanced angle chamber 41 and the retarded angle chamber 42 via the cancellation passage (26, 35) is interrupted when the restriction member 5 approaches one of the first and second end portions 25*a* and 25*b* of the restriction recessed portion 25.

Accordingly, by configuring the valve timing control device 1 so that the communication between the first passage 26 and the second passage 35 on the one hand and one of the advanced angle chambers 41 or one of the retarded angle chambers 42 on the other hand, respectively, is interrupted when the restriction member 5 approaches either one of the first end portion 25*a* and the second end portion 25*b* of the restriction recessed portion 25, a range of phase by which the communication between the first passage 26 and the second passage 35 on the one hand and one of the advanced angle chambers 41 or one of the retarded angle chambers 42 on the other hand, respectively, is blocked may be enlarged. Accordingly, the chances of the restriction member 5 being retracted from the restriction recessed portion 25 may be decreased when comparing to a case where the communication between the first passage 26 and the second passage 35 on the one hand and one of the advanced angle chambers 41 or one of the retarded angle chambers 42 on the other hand, respectively, is blocked only when the restriction member 5 contacts the second end portion 25*b* of the restriction recessed portion 25. Therefore, the relative rotational phase may surely be locked or restricted at the predetermined phase. The term "approach" indicates that the restriction member 5 being positioned within a range shorter than the length of the restriction recessed portion 25 from the first end portion 25*a* of the restriction recessed portion 25 and the second end portion 25*b*.

According to the embodiment, the restriction cancellation passage includes the first passage 26, which is formed on the other one of the outer rotor 2 and the inner rotor 3 so as to be connected to the one of the advanced angle chamber 41 and the retarded angle chamber 42, and the second passage 35, which is formed on the one of the outer rotor 2 and the inner rotor 3 on which the accommodation portion 34 is formed so as to be connected to the accommodation portion 34 and so as to connect the first passage 26 and the accommodation portion 34 in order to establish the communication therebetween in response to the rotatable movement of the inner rotor 3 relative to the outer rotor 2.

Accordingly, the first passage 26 is formed on the outer rotor 2, so that the first passage 26 is connected to either to the advanced angle chamber 41 or the retarded angle chamber 42. Furthermore, the second passage 35 is formed on the inner rotor 3 so as to be connected to the accommodation portion 34. Accordingly, because the first passage 26 and the second passage 35 are formed on different rotational members (i.e. the outer rotor 3 and the inner rotor 2), the communication between the first passage 25 and either one of the advanced angle chamber 41 and the retarded angle chamber 42 may be blocked only by executing the advanced angle control or the retarded angle control.

According to the embodiments, the valve timing control device 1 further includes the retaining passage (36, 37), which differs from the second passage 35 and which is formed at one of the outer rotor 2 and the inner rotor 3, on which the accommodation portion 34 is formed, so as to connect one of the advanced angle chamber 41 and the retarded angle chamber 42 on the one hand and the accommodation portion 34 on the other in order to establish the communication therebetween. Furthermore, the retaining passage (36, 37) is configured so as to retain the restriction member 5 to be retracted from the restriction recessed portion 25 while the restriction generated between the restriction member 5 and the restriction recessed portion 25 is cancelled.

Accordingly, the restriction member 5 is maintained to be retracted from the restriction recessed portion 25 via the retaining passage (36, 37), which is connected either to one of the advanced angle chambers 41 or to one of the retarded angle chambers 42. In other words, even if the communication between the first passage 26 and the accommodation portion 34 via the second passage 35 is interrupted, the restriction member 5 may be maintained to be retracted from the restriction recessed portion 25 only by executing the advanced angle control or the retarded angle control. Accordingly, a separate control mechanism for maintaining the restriction member 5 to be retracted from the restriction recessed portion 25 does not need to be additionally provided to the valve timing control device 1 according to the above-described embodiments. Furthermore, because the retaining passage (36, 37) is formed on the inner rotor 3, on which the accommodation portion 34 is formed, the retaining passage (36, 37) is easily formed.

According to the second embodiment, the restriction member 5 includes the stepped portion 152*d* so that the diameter of the restriction member 5 increases in the retracting direction via the stepped portion 152*d*. Further, the second passage 35 connects the first passage 26 and the clearance 38 formed between the accommodation portion 34 and the stepped portion 152*d* of the restriction member 5 so that the first passage 26 becomes in communication with the clearance 38. Furthermore, the retaining passage 36 connects one of the advanced angle chamber 41 and the retarded angle chamber 42 on the one hand and the clearance 38 on the other in order to establish the communication therebetween.

Accordingly, the stepped portion 152*d* is formed on the restriction member 5, so that the clearance 38 is formed between the stepped portion 152*d* and the accommodation portion 34. The second passage 35 connects the clearance 38 and the first passage 26. Further, the retaining passage 36 connects the clearance 38 and either one of the advanced angle chamber 41 and the retarded angle chamber 42. Therefore, relatively large range within which the second passage 35 and the retaining passage 36 are formed is ensured when comparing to a case where the second passage 35 and the retaining passage 36 are connected to the clearance 29, which is formed between the end portion 52*f* of the restriction member 5, which is inserted into the restriction recessed portion 25, and the accommodation portion 34. Accordingly, the second passage 35 and the retaining passage 36 are easily formed.

According to the embodiments, the communication between the first passage 26 and the accommodation portion 34 via the second passage 35 is interrupted and the first passage 26 is connected to one of the advanced angle chamber 41 and the retarded angle chamber 42, which differs from the other one of the advanced angle chamber 41 and the retarded angle chamber 42 for displacing the relative rotational phase towards the predetermined phase from the most advanced angle phase or the most retarded angle phase, when the restriction portion 5 approaches to one of the first and second end portions 25*a* and 25*b*, which is an opposite end portion from the end portion positioned so as to correspond to the predetermined phase.

Accordingly, the restriction member 5 is not retracted from the restriction recessed portion 25 and is not displaced so as to move over the second end portion 25*b* of the restriction recessed portion 25 positioned so as to correspond to the predetermined phase even when, for example, the engine is started while the relative rotational phase is retained at the most advanced angle phase or the most retarded angle phase and then the relative rotational phase is displaced towards the predetermined phase. Therefore, the restriction member 5 is pressed against the second end portion 25*b* of the restriction recessed portion 25 positioned so as to correspond to the predetermined phase by the displacement force. As a result, the relative rotational phase is controlled to be the predetermined phase after the engine is started only by executing the advanced angle control or the retarded angle control.

According to the first embodiment, the retaining passage includes the first retaining passage 36 and the second retaining passage 37. The first retaining passage 36 connects one of the advanced angle chamber 41 and the retarded angle chamber 42 with the accommodation portion 34. The second retaining passage 37 is configured so as to differ from the second passage 35 and is formed on one of the outer rotor 2 and the inner rotor 3, on which the accommodation portion 34 is formed, so as to connect the other one of the advanced angle chamber 41 and the retarded angle chamber 42 with the accommodation portion 34 while the restriction generated between the restriction member 5 and the restriction recessed portion 25 is cancelled. Furthermore, the second retaining passage 37 retains the state where the restriction between the restriction member 5 and the restriction recessed portion 25 is cancelled.

Accordingly, the first retaining passage 36 is configured so as to be connected to one of the advanced angle chamber 41 and the retarded angle chamber 42. Further, the second retaining passage 37 is configured so as to be connected to the other one of the advanced angle chamber 41 and the retarded angle chamber 42. Accordingly, when the restriction member 5 is not inserted into the restriction recessed portion 25, at least one of the advanced angle chamber 41 and the retarded angle chamber 42 is normally connected to the accommodation portion 34 in order to establish the communication therebetween. Therefore, once the restriction member 5 is retracted from the restriction recessed portion 25, the operation fluid is normally supplied to the accommodation portion 34 via at least one of the first passage 36 and the second passage 37, so that the restriction member 5 is maintained to be retracted from the restriction recessed portion 25 until the engine is stopped. Accordingly, after the restriction member 5 is retracted from the restriction recessed portion 25, the relative rotational phase is freely displaceable within the range between the most advanced angle phase and the most retarded angle phase.

According to the first embodiment, the restriction member 5 includes plural stepped portions (52*d*, 52*e*) so that the diameter of the restriction member 5 increases in the retracting direction via the plural stepped portions (52*d*, 52*e*). The second passage 35 connects the first passage 26 and the clearance 38, which is formed between the accommodation portion 34 and one of plural stepped portions (52*d*, 52*e*) in order to establish the communication therebetween. Furthermore, the first retaining passage 36 connects the clearance 38 formed between the accommodation portion 34 and one of plural of stepped portions (52*d*, 52*e*) with one of the advanced angle chamber 41 and the retarded angle chamber 42. The second retaining passage 37 connects the clearance 39 formed between the accommodation portion 34 and another one of plural stepped portions (52*d*, 52*e*) with the other one of advanced angle chamber 41 and the retarded angle chamber 42. Furthermore, at least the clearance 38 and the clearance 39 are separately formed at different positions between the restriction member 5 and the accommodation portion 34.

Accordingly, by configuring the restriction member 5 to include plural stepped portions (52*d*, 52*e*) so that the clearance 38, to which the first retaining passage 36 is connected, is formed separately from the clearance 39, to which the second retaining passage 37 is connected, the first retaining passage 36 may be avoided from being connected to the second retaining passage 37. Therefore, the operation fluid supplied from one of the first and second retaining passages 36 and 37 is avoided from being discharged to the other one of the first and second retaining passages 36 and 37. Accordingly, the restriction member 5 may be retained to be retracted from the restriction recessed portion 25 while avoiding the restriction member 5 from being improperly operated.

According to the embodiments, the communication between the first passage 26 and the accommodation portion 34 via the second passage 35 is interrupted and the first passage 26 is connected to one of the advanced angle chamber 41 and the retarded angle chamber 42 for displacing the relative rotational phase towards the predetermined phase from the most advanced angle phase or the most retarded angle phase when the restriction member 5 approaches the other one of the first and second end portions 25*a* and 25*b* of the restriction recessed portion 25 positioned so as to correspond to the predetermined phase.

Accordingly, when the restriction member 5 approaching the second end portion 25*b* of the restriction recessed portion 25 positioned so as to correspond to the predetermined phase, the second passage 35 is not connected to the first passage 26. In other words, once the relative rotational phase is displaced so that the restriction member 5 approaches the second end portion 25*b* of the restriction recessed portion 25 positioned so as to correspond to the predetermined phase, and then, the relative rotational phase is displaced towards the predetermined phase, the restriction portion 5 is pressed against the second end portion 25*b* of the restriction recessed portion 25 positioned so as to correspond to the predetermined phase by the displacement force. As a result, the relative rotational phase is retained at the predetermined phase when necessary only by executing the advanced angle control or the retarded angle control. Furthermore, by displacing the relative rotational phase towards the predetermined phase while the second passage 35 is in communication with the first passage 26, the restriction member 5 may be operated so as to move over the second end portion 25*b* of the restriction recessed portion 25 positioned so as to correspond to the predetermined and so as to be disengaged from the restriction recessed portion 25.

According to the second embodiment, one of the advanced angle chamber 41 and the retarded angle chamber 42 to which the first passage is connected is the same as the one of the advanced angle chamber 41 and the retarded angle chamber 42 to which the retaining passage 36 is connected.

Accordingly, by configuring the first passage 25 and the retaining passage 36 to be connected to the same one of the advanced angle chamber 41 and the retarded angle chamber 42, the restriction member 5 is retained to be retracted from the restriction recessed portion 25 even in a case where the communication between the first passage 26 and the second passage 35 is interrupted after the restriction member 5 is retracted from the restriction recessed portion 25.

According to the embodiments, the clearance (38, 39) is formed in a circular shaped space.

Accordingly, by forming the clearance (38, 39) between the stepped portion (52*d*, 52*e*, 152*d*) of the restriction member 5 and the accommodation portion 34 in the circular shape, the fluid pressure of the operation fluid evenly acts on the entire stepped portion (52*d*, 52*e*, 152*d*) of the restriction member 5. Accordingly, the restriction member 5 is smoothly retracted from the restriction recessed portion 25, and further, the restriction member 5 is stably retained to be retracted from the restriction recessed portion 25. Furthermore, chance of the restriction member 5 being improperly operated by jouncing (backlash) when being retracted from the restriction recessed portion 25 may be reduced.

According to the embodiments, the valve timing control device 1 includes the lock mechanism 6 for locking the relative rotational phase either at the most advanced angle phase, the most retarded angle phase or the predetermined phase.

Accordingly, because the valve timing control device 1 of the above-described embodiments includes the lock mechanism 6, the relative rotational phase is surely locked either in a phase, which is formed when the restriction member 5 contacts the first end portion 25*a* of the restriction member 25, or in a phase, which is formed when the restriction member 5 contacts the second end portion 25*b* of the restriction member 25, i.e. the relative rotational phase is surely locked either at the most advanced angle phase, the most retarded angle phase or the predetermined phase.

Accordingly, in the case where the valve timing control device 1 is adapted to the intake valves, the engine may be started under the condition where the relative rotational phase is retained at the predetermined phase between the most advanced angle phase and the most retarded angle phase and where the relative rotational phase, more specifically, under the condition where the relative rotational phase is surely locked at a phase by which the engine is startable. As a result, the relative rotational phase may be displaced towards the retarded angle phase relative to the predetermined phase after the engine is started and driven afterwards. Accordingly, the efficiency of the fuel consumption, the output of the engine and the like may be improved.

Accordingly, in the case where the valve timing control device 1 is adapted to the exhaust valves, the engine may be started under the condition where the relative rotational phase is surely locked at the most advanced angle phase. As a result, even in the case where the engine is started while the engine is cold (i.e. the cold start), the occurrence of hydrocarbon (i.e. cold HC) may be restricted. Accordingly, the valve timing control device 1 of the embodiments is practically used.

According to the first embodiment, the restriction member 5 includes the leak passage (53, 54, 55) for opening the clearance (38, 39) formed between the restriction member 5 and the accommodation portion 34 to the atmosphere when the displacement of the relative rotational phase is restricted.

Accordingly, because the valve timing control device 1 of the embodiments includes the leak passage (27, 53, 54, 55), even if the operation fluid unexpectedly leaks to the clearance (38, 39) formed between the accommodation portion 34 and the restriction member 5 and the clearance (29) between the restriction member 5 and the restriction recessed portion 25 while the restriction member 5 is inserted into the restriction recessed portion 25, the leaked operation fluid is discharged to the atmosphere. Accordingly, the restriction member 5 is avoided from being improperly retracted from the restriction recessed portion 25 by the fluid pressure of the leaked operation fluid.

The principles, preferred embodiment and mode of operation of the present invention have been described in the foregoing specification. However, the invention which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the present invention. Accordingly, it is expressly intended that all such variations, changes and equivalents which fall within the spirit and scope of the present invention as defined in the claims, be embraced thereby.

The invention claimed is:

1. A valve timing control device comprising:

a driving side rotational member synchronously rotatable with a crankshaft of an internal combustion engine;

a driven side rotational member arranged coaxially with the driving side rotational member and synchronously rotatable with a camshaft that controls opening and closing operations of a valve of the internal combustion engine;

a fluid pressure chamber defined by the driving side rotational member and the driven side rotational member;

a parting portion provided at at least one of the driving side rotational member and the driven side rotational member in order to divide the fluid pressure chamber into an advanced angle chamber and a retarded angle chamber;

a restriction member accommodated within an accommodation portion, which is formed at one of the driving side rotational member and the driven side rotational member and being insertable into and retractable from the other one of the driving side rotational member and the driven side rotational member;

a restriction recessed portion formed in an elongated groove shape at the other one of the driving side rotational member and the driven side rotational member so that the restriction member is insertable thereinto and restricting a displacement of a relative rotational phase of the driven side rotational member relative to the driving side rotational member in a range between one of a most advanced angle phase and a most retarded angle phase on the one hand and a predetermined phase between the most advanced angle phase and the most retarded angle phase on the other when the restriction member is inserted into the restriction recessed portion; and a restriction cancellation passage for connecting one of the advanced angle chamber and the retarded angle chamber and the accommodation portion in response to a rotatable movement of the driven side rotational member relative to the driving side rotational member so that the accommodation portion becomes in communication with the one of the advanced angle chamber and the retarded angle chamber and for canceling a restriction generated between the restriction member and the restriction recessed portion, wherein a communication between the accommodation portion and the one of the advanced angle chamber and the retarded angle chamber via the cancellation passage is interrupted at least when the restriction member contacts one of first and second end portions of the restriction recessed portion in a rotational direction of the other one of the driving side rotational member and the driven side rotational member, and the restriction member is restricted so as not to move over the other one of the first and second end portions of the restriction recessed portion, positioned so as to correspond to the predetermined phase, to be disengaged from the restriction recessed portion.

2. The valve timing control device according to claim 1, wherein the communication between the accommodation portion and the one of the advanced angle chamber and the retarded angle chamber via the cancellation passage is interrupted when the restriction member approaches the one of the first and second end portions of the restriction recessed portion.

3. The valve timing control device according to claim 1, wherein the restriction cancellation passage includes a first passage, which is formed on the other one of the driving side rotational member and the driven side rotational member so as to be connected to the one of the advanced angle chamber and the retarded angle chamber, and a second passage, which is formed on the one of the driving side rotational member and the driven side rotational member on which the accommodation portion is formed so as to be connected to the accommodation portion and so as to connect the first passage and the accommodation portion in order to establish a communication therebetween in response to the rotatable movement of the driven side rotational member relative to the driving side rotational member.

4. The valve timing control device according to claim 2, wherein the restriction cancellation passage includes a first passage, which is formed on the other one of the driving side rotational member and the driven side rotational member so as to be connected to the one of the advanced angle chamber and the retarded angle chamber, and a second passage, which is formed on the one of the driving side rotational member and the driven side rotational member on which the accommodation portion is formed so as to be connected to the accommodation portion and so as to connect the first passage and the accommodation portion in order to establish a communication therebetween in response to the rotatable movement of the driven side rotational member relative to the driving side rotational member.

5. The valve timing control device according to claim 3 further comprising a retaining passage, which differs from the second passage and which is formed at the one of the driving side rotational member and the driven side rotational member, on which the accommodation portion is formed, so as to connect the one of the advanced angle chamber and the retarded angle chamber on the one hand and the accommodation portion on the other in order to establish a communication therebetween, wherein the retaining passage retains the restriction member to be retracted from the restriction recessed portion while the restriction generated between the restriction member and the restriction recessed portion is cancelled.

6. The valve timing control device according to claim 4 further comprising a retaining passage, which differs from the second passage and which is formed at the one of the driving side rotational member and the driven side rotational member, on which the accommodation portion is formed, so as to connect the one of the advanced angle chamber and the retarded angle chamber on the one hand and the accommodation portion on the other in order to establish a communication therebetween, wherein the retaining passage retains the restriction member to be retracted from the restriction recessed portion while the restriction generated between the restriction member and the restriction recessed portion is cancelled.

7. The valve timing control device according to claim 5, wherein the restriction member includes a stepped portion so that a diameter of the restriction member increases in a retracting direction via the stepped portion, the second passage connects the first passage and a clearance formed between the accommodation portion and the stepped portion of the restriction member so that the first passage becomes in communication with the clearance, and wherein the retaining passage connects the one of the advanced angle chamber and the retarded angle chamber on the one hand and the clearance on the other in order to establish a communication therebetween.

8. The valve timing control device according to claim 6, wherein the restriction member includes a stepped portion so that a diameter of the restriction member increases in a retracting direction via the stepped portion, the second passage connects the first passage and a clearance formed between the accommodation portion and the stepped portion of the restriction member so that the first passage becomes in communication with the clearance, and wherein the retaining passage connects the one of the advanced angle chamber and the retarded angle chamber on the one hand and the clearance on the other in order to establish a communication therebetween.

9. The valve timing control device according to claim 5, wherein the communication between the first passage and the accommodation portion via the second passage is interrupted and the first passage is connected to the one of the advanced angle chamber and the retarded angle chamber, which differs from the other one of the advanced angle chamber and the retarded angle chamber for displacing the relative rotational phase towards the predetermined phase from the most advanced angle phase or the most retarded angle phase, when the restriction portion approaches to the one of the first and second end portions, which is an opposite end portion from the end portion positioned so as to correspond to the predetermined phase.

10. The valve timing control device according to claim 6, wherein the communication between the first passage and the accommodation portion via the second passage is interrupted and the first passage is connected to the one of the advanced angle chamber and the retarded angle chamber, which differs from the other one of the advanced angle chamber and the retarded angle chamber for displacing the relative rotational phase towards the predetermined phase from the most advanced angle phase or the most retarded angle phase, when the restriction portion approaches to the one of the first and second end portions, which is an opposite end portion from the end portion positioned so as to correspond to the predetermined phase.

11. The valve timing control device according to claim 9, wherein the retaining passage includes a first retaining passage and a second retaining passage, the first retaining passage connects one of the advanced angle chamber and the retarded angle chamber with the accommodation portion, the second retaining passage differs from the second passage and is formed on the one of the driving side rotational member and the driven side rotational member, on which the accommodation portion is formed, so as to connect the other one of the advanced angle chamber and the retarded angle chamber with the accommodation portion while the restriction generated between the restriction member and the restriction recessed portion is cancelled and the second retaining passage retains a state where the restriction between the restriction member and the restriction recessed portion is cancelled.

12. The valve timing control device according to claim 10, wherein the retaining passage includes a first retaining passage and a second retaining passage, the first retaining passage connects one of the advanced angle chamber and the retarded angle chamber with the accommodation portion, the second retaining passage differs from the second passage and is formed on the one of the driving side rotational member and the driven side rotational member, on which the accommodation portion is formed, so as to connect the other one of the advanced angle chamber and the retarded angle chamber with the accommodation portion while the restriction generated between the restriction member and the restriction recessed portion is cancelled and the second retaining passage retains a state where the restriction between the restriction member and the restriction recessed portion is cancelled.

13. The valve timing control device according to claim 11, wherein the restriction member includes a plurality of stepped portions so that the diameter of the restriction member increases in the retracting direction via the plurality of stepped portions, the second passage connects the first passage and a first clearance formed between the accommodation portion and one of the plurality of stepped portions in order to establish a communication therebetween, the first retaining passage connects a second clearance formed between the accommodation portion and one of the plurality of stepped portions with the one of the advanced angle chamber and the retarded angle chamber, the second retaining passage connects a third clearance formed between the accommodation portion and another one of the plurality of stepped portions with the other one of advanced angle chamber and the retarded angle chamber, and wherein at least the second clearance and the third clearance are separately formed at different positions between the restriction member and the accommodation portion.

14. The valve timing control device according to claim 12, wherein the restriction member includes a plurality of stepped portions so that the diameter of the restriction member increases in the retracting direction via the plurality of stepped portions, the second passage connects the first passage and a first clearance formed between the accommodation portion and one of the plurality of stepped portions in order to establish a communication therebetween, the first retaining passage connects a second clearance formed between the accommodation portion and one of the plurality of stepped portions with the one of the advanced angle chamber and the retarded angle chamber, the second retaining passage connects a third clearance formed between the accommodation portion and another one of the plurality of stepped portions with the other one of advanced angle chamber and the retarded angle chamber, and wherein at least the second clearance and the third clearance are separately formed at different positions between the restriction member and the accommodation portion.

15. The valve timing control device according to claim 7, wherein the communication between the first passage and the accommodation portion via the second passage is interrupted and the first passage is connected to the one of the advanced angle chamber and the retarded angle chamber for displacing the relative rotational phase towards the predetermined phase from the most advanced angle phase or the most retarded angle phase when the restriction member approaches the other one of the first and second end portions of the restriction recessed portion positioned so as to correspond to the predetermined phase.

16. The valve timing control device according to claim 8, wherein the communication between the first passage and the accommodation portion via the second passage is interrupted and the first passage is connected to the one of the advanced angle chamber and the retarded angle chamber for displacing the relative rotational phase towards the predetermined phase from the most advanced angle phase or the most retarded angle phase when the restriction member approaches the other one of the first and second end portions of the restriction recessed portion positioned so as to correspond to the predetermined phase.

17. The valve timing control device according to claim 15, wherein the one of the advanced angle chamber and the retarded angle chamber to which the first passage is connected is the same as the one of the advanced angle chamber and the retarded angle chamber to which the retaining passage is connected.

18. The valve timing control device according to claim 16, wherein the one of the advanced angle chamber and the retarded angle chamber to which the first passage is connected is the same as the one of the advanced angle chamber and the retarded angle chamber to which the retaining passage is connected.

19. The valve timing control device according to any one of claim 1, wherein the restriction member includes a leak passage for opening the clearance formed between the restriction member and the accommodation portion to an atmosphere when the displacement of the relative rotational phase is restricted.

20. A valve timing control device comprising:

an outer rotor synchronously rotatable with a crankshaft of an internal combustion engine;

an inner rotor arranged coaxially with the outer rotor and synchronously rotatable with a camshaft that controls opening and closing operations of a valve of the internal combustion engine;

a fluid pressure chamber defined by the outer rotor and the inner rotor;

a parting portion provided at at least one of the outer rotor and the inner rotor so as to divide the fluid pressure chamber into an advanced angle chamber and a retarded angle chamber;

a restriction member accommodated within an accommodation portion, which is formed at one of the outer rotor and the inner rotor and being insertable into and retractable from the other one of the outer rotor and the inner rotor;

a restriction recessed portion formed in an elongated groove shape at the other one of the outer rotor and the inner rotor so that the restriction member is insertable thereinto and restricting a displacement of a relative rotational phase of the inner rotor relative to the outer rotor in a range between one of a most advanced angle phase and a most retarded angle phase on the one hand and a predetermined phase between the most advanced angle phase and the most retarded angle phase on the other when the restriction member is inserted into the restriction recessed portion; and a restriction cancellation passage for connecting one of the advanced angle chamber and the retarded angle chamber with the accommodation portion in response to a rotatable movement of the inner rotor relative to the outer rotor so that the accommodation portion becomes in communication with the one of the advanced angle chamber and the retarded angle chamber and for canceling a restriction generated between the restriction member and the restriction recessed portion, wherein a communication between the accommodation portion and the one of the advanced angle chamber and the retarded angle chamber via the cancellation passage is interrupted at least when the restriction member contacts one of first and second end portions of the restriction recessed portion in a rotational direction of the other one of the outer rotor and the inner rotor, and a range of the relative rotational phase of the inner rotor relative to the outer rotor to be displaced is restricted to a range between the one of the most advanced angle phase and the most retarded angle phase on the one hand and the predetermined phase between the most advanced angle phase and the most retarded angle phase on the other.

* * * * *